United States Patent [19]

Chamberlin, III et al.

[11] Patent Number: 4,941,984

[45] Date of Patent: Jul. 17, 1990

[54] LUBRICATING OIL COMPOSITIONS AND METHODS FOR LUBRICATING GASOLINE-FUELED AND/OR ALCOHOL-FUELED, SPARK-IGNITED ENGINES

[75] Inventors: William B. Chamberlin, III, Kirtland; Frank V. Zalar, Novelty, both of Ohio

[73] Assignee: The Lubrizol Corporation, Wickliffe, Ohio

[21] Appl. No.: 387,719

[22] Filed: Jul. 31, 1989

[51] Int. Cl.[5] ..... C10M 105/22

[52] U.S. Cl. ..... 252/39

[58] Field of Search ..... 252/39

[56] References Cited

U.S. PATENT DOCUMENTS

| | | | |
|---|---|---|---|
| Re. 27,331 | 4/1972 | Coleman | 252/47.5 |
| 2,197,832 | 4/1940 | Reiff | 87/9 |
| 2,252,662 | 8/1941 | Reiff | 260/429 |
| 3,172,892 | 3/1965 | LeSuer et al. | 260/326.5 |
| 3,219,666 | 11/1965 | Norman et al. | 260/268 |
| 3,410,798 | 11/1968 | Cohen | 252/37.2 |
| 3,522,179 | 7/1970 | LeSuer | 252/51.5 |
| 3,595,791 | 7/1971 | Cohen | 252/33.6 |
| 3,804,763 | 4/1974 | Meinhardt | 252/51.5 A |
| 3,948,800 | 4/1976 | Meinhardt | 252/356 |
| 3,957,854 | 5/1976 | Miller | 260/482 R |
| 4,119,549 | 10/1978 | Davis | 252/45 |
| 4,234,435 | 11/1980 | Meinhardt et al. | 252/51.5 A |
| 4,263,150 | 4/1981 | Clason et al. | 252/32.7 E |
| 4,289,635 | 9/1981 | Schroeck | 252/32.7 E |
| 4,308,154 | 12/1981 | Clason et al. | 252/32.7 E |
| 4,417,990 | 11/1983 | Clason et al. | 252/32.7 E |
| 4,466,895 | 8/1984 | Schroeck | 252/32.7 E |

FOREIGN PATENT DOCUMENTS 1440219 6/1976 United Kingdom .

*Primary Examiner*—Olik Chaudhuri
*Assistant Examiner*—James M. Hunter, Jr.
*Attorney, Agent, or Firm*—Forrest L. Collins; Frederick D. Hunter; Robert A. Franks

[57] ABSTRACT

A lubricating oil composition is described which is useful in spark-ignited engines which may be fueled with gasoline, alcohol, or mixtures of both. More particularly, lubricating oil compositions for spark-ignited engines are described which comprise (A) an oil of lubricating viscosity; (B) at least one detergent selected from the group consisting of a basic magnesium salt of an organic acid or a mixture of at least one basic magnesium salt of an organic acid and another alkaline earth metal salt of an organic acid wherein the metal in the mixture is predominantly magnesium; and (C) at least one metal salt of (C-1) a substituted succinic acid acylated polyamine; or (C-2) a hydrocarbon-substituted aromatic carboxylic acid containing at least one hydroxyl group attached to an aromatic ring, provided that the metal of said metal salt (C) is not calcium or magnesium. Lubricants primarily useful for lubricating alcohol-fueled, spark-ignited engines also are described which comprise (A) a lubricating oil, (B) a detergent as described above, and (D) at least one carboxylic acid derivative composition useful as a dispersant.

The oil compositions of the invention also may contain, and generally do contain other desirable additives such as (E) mixtures of metal salts of dihydrocarbyl phosphorodithioic acids; (F) sulfurized olefins; etc. In one embodiment, the oil compositions of the present invention contain the above additives and other additives described in the specification in amounts sufficient to enable the oil to meet all the performance requirements of the API Service Classification identified as "SG".

52 Claims, No Drawings

LUBRICATING OIL COMPOSITIONS AND METHODS FOR LUBRICATING GASOLINE-FUELED AND/OR ALCOHOL-FUELED, SPARK-IGNITED ENGINES

TECHNICAL FIELD

This invention relates to lubricating oil compositions and to methods for lubricating spark-ignited engines. In particular, this invention relates to lubricating oil compositions which are useful in alcohol-fueled, spark-ignited engines. The lubricating oil is effective in reducing corrosive wear and deposits in the combustion chamber and is also useful in preventing or reducing pre-ignition in the engines.

BACKGROUND OF THE INVENTION

In recent years, there has been an increased interest in the use of alcohols, and in particular, methanol and ethanol, as a fuel for operating internal combustion engines. The early interest in alcohol powered internal combustion engines resulted from the shortages or threatened shortages such as occurred in the 1970's. However, when the threat of a shortage diminished, the automotive companies reduced their efforts to find alternative fuels which required changes in the design of engines to permit the engines to operate on alcohol fuel.

Internal combustion engines which can operate on both gasoline and alcohol, the so-called "flexible-fuel" or "variable-fuel" vehicles are particularly desirable since it may not always be possible, especially during an interim or changeover period, of finding service stations selling alcohol fuels If only gasoline is available in a particular area, the vehicle must be capable of performing with gasoline as well as alcohol Attempts to substitute alcohol for gasoline as a fuel for internal combustion engines results in a variety of problems. Methanol has 40% less energy than gasoline, and, therefore, the miles per gallon obtained with methanol will be reduced by about 40% thereby requiring the vehicles to have larger fuel tanks. The automotive manufacturers also must design engines which take into consideration the fact that methanol is much more corrosive than gasoline. Not only does the fuel tank need to be made of corrosion-resistant materials such as stainless steel, the entire fuel delivery system has to be engineered with corrosion-resistant materials.

It also has been observed that when engines are operated with methanol as a fuel, corrosive wear and pre-ignition problems are often observed due to the presence of hot spots and the formation of ash deposits in the combustion chamber.

Although a number of the above-described problems and others which result from the use of alcohol fuels in internal combustion engines can be and are being resolved by optimization of internal engine components and by the use of new component technology such as electronic controls, modification of the lubricating oil compositions used to lubricate such engines is desirable. For example, efforts are underway to modify existing lubricating oils or to develop new lubricating oil formulations which are particularly useful in alcohol-fueled internal combustion engines, and when used in alcohol-powered internal combustion engines will prevent or minimize the pre-ignition and corrosion problems At the present time, it is further desired that the lubricating oil composition which is useful in an alcohol-fueled spark-ignited engine be also useful in lubricating gasoline-fueled, spark-ignited engines.

SUMMARY OF THE INVENTION

A lubricating oil composition is described which is useful in spark-ignited engines which may be fueled with gasoline, alcohol, or mixtures of both. More particularly, lubricating oil compositions for spark-ignited engines are described which comprise (A) an oil of lubricating viscosity; (B) at least one detergent selected from the group consisting of a basic magnesium salt of an organic acid or a mixture of at least one basic magnesium salt of an organic acid and another alkaline earth metal salt of an organic acid wherein the metal in the mixture is predominantly magnesium; and (C) at least one metal salt of (C-1) a substituted succinic acid acylated polyamine; or (C-2) a hydrocarbon-substituted aromatic carboxylic acid containing at least one hydroxyl group attached to an aromatic ring, provided that the metal of said metal salt (C) is not calcium or magnesium. Lubricants primarily useful for lubricating alcohol-fueled, spark-ignited engines also are described which comprise (A) a lubricating oil, (B) a detergent as described above, and (D) at least one carboxylic acid derivative composition useful as a dispersant.

The oil compositions of the invention also may contain, and generally do contain other desirable additives such as (E) mixtures of metal salts of dihydrocarbyl phosphorodithioic acids; (F) sulfurized olefins; etc. In one embodiment, the oil compositions of the present invention contain the above additives and other additives described in the specification in amounts sufficient to enable the oil to meet all the performance requirements of the API Service Classification identified as "SG".

DESCRIPTION OF THE PREFERRED EMBODIMENTS (A) Oil of Lubricating Viscosity.

The oil which is utilized in the preparation of the lubricants of the invention may be based on natural oils, synthetic oils, or mixtures thereof.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra-(p-tert-butylphenyl)silicate, hexyl-(4-methyl-2-pentoxy)disiloxane, poly(methyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, hydrotreating, secondary distillation, acid or base extraction, filtration, percolation, etc. Rerefined oils are obtained by processes similar to those used to obtain refined oils applied to refined oils which have been already used in service. Such rerefined oils are also known as reclaimed, recycled, or reprocessed oils and often are additionally processed by techniques directed to removal of spent additives and oil breakdown products.

(B) Detergents.

An essential component of the lubricating oil compositions of the present invention is at least one detergent which is selected from the group consisting of a basic magnesium salt of an organic acid, or a mixture of at least one basic magnesium salt of an organic acid and another alkaline earth metal salt of an organic acid wherein the metal in the mixture is predominantly magnesium. Such detergents generally are referred to in the art as ash-containing detergents. The acidic organic compound may be at least one sulfur acid, carboxylic acid, phosphorus acid, or phenol, or mixtures thereof.

Ash-containing detergents used in the oil compositions of the present invention may be exclusively magnesium salts of organic acids. Alternatively, the ash-containing detergents contained in the lubricating oils of the present invention may be mixtures of metal salts wherein at least one of the metal salts is a magnesium salt, and the metal in the mixture is predominantly magnesium, i.e., of the metals present in the mixed detergent, more than 50% by weight is magnesium. In one preferred embodiment, the detergent (B) present in the lubricating oil composition is a basic magnesium salt of an organic acid, and no calcium salts of organic acids are present.

The basic magnesium salt and the other basic alkaline earth metal salts in the mixtures useful as detergents in the present invention are referred to as basic salts because they contain an excess of the magnesium or other alkaline earth metal cation. Generally, the basic or overbased salts will have metal ratios of up to about 40 and more particularly will have a metal ratio of about 2 to about 30 or 40.

A commonly employed method for preparing the basic (or overbased) salts comprises heating a mineral oil solution of the acid with a stoichiometric excess of a metal neutralizing agent, e.g., a metal oxide, hydroxide, carbonate, bicarbonate, sulfide, etc., at temperatures above about 50° C. In addition, various promoters may be used in the overbasing process to aid in the incorporation of the large excess of metal. These promoters include such compounds as the phenolic substances, e.g., phenol, naphthol, alkylphenol, thiophenol, sulfurized alkylphenol and the various condensation products of formaldehyde with a phenolic substance; alcohols such as methanol, 2-propanol, octyl alcohol, cellosolve carbitol, ethylene, glycol, stearyl alcohol, and cyclohexyl alcohol; amines such as aniline, phenylenediamine, phenothiazine, phenyl-beta-naphthylamine, and dodecyl amine, etc. A particularly effective process for preparing the basic barium salts comprises mixing the acid with an excess of barium in the presence of the phenolic promoter and a small amount of water and carbonating the mixture at an elevated temperature, e.g., 60° C. to about 200° C.

As mentioned above, the acidic organic compound from which the salt of component (B) is derived may be at least one sulfur acid, carboxylic acid, phosphorus acid, or phenol or mixtures thereof. The sulfur acids may be sulfonic acids, thiosulfonic, sulfinic, sulfenic, partial ester sulfuric, sulfurous and thiosulfuric acids. Sulfonic acids are preferred.

The sulfonic acids which are useful in preparing component (B) include those represented by the formulae $$R_xT(SO_3H)_y \quad \text{(I)}$$

and $$R'(SO_3H)_r \quad \text{(II)}$$

In these formulae, R′ is an aliphatic or aliphatic-substituted cycloaliphatic hydrocarbon or essentially hydrocarbon group free from acetylenic unsaturation and containing up to about 60 carbon atoms. When R′ is aliphatic, it usually contains at least about 15 carbon atoms; when it is an aliphatic-substituted cycloaliphatic group, the aliphatic substituents usually contain a total of at least about 12 carbon atoms. Examples of R' are alkyl, alkenyl and alkoxyalkyl radicals, and aliphatic-substituted cycloaliphatic groups wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of R' are cetylcyclohexyl, laurylcyclohexyl, cetyloxyethyl, octadecenyl, and groups derived from petroleum, saturated and unsaturated paraffin wax, and olefin polymers including polymerized monoolefins and diolefins containing about 2–8 carbon atoms per olefinic monomer unit. R' can also contain other substituents such as phenyl, cycloalkyl, hydroxy, mercapto, halo, nitro, amino, nitroso, lower alkoxy, lower alkylmercapto, carboxy, carbalkoxy, oxo or thio, or interrupting groups such as —NH—, —O— or —S—, as long as the essentially hydrocarbon character thereof is not destroyed.

R in Formula I is generally a hydrocarbon or essentially hydrocarbon group free from acetylenic unsaturation and containing from about 4 to about 60 aliphatic carbon atoms, preferably an aliphatic hydrocarbon group such as alkyl or alkenyl. It may also, however, contain substituents or interrupting groups such as those enumerated above provided the essentially hydrocarbon character thereof is retained. In general, any non-carbon atoms present in R' or R do not account for more than 10% of the total weight thereof.

T is a cyclic nucleus which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene nucleus.

The subscript x is at least 1 and is generally 1–3. The subscripts r and y have an average value of about 1–2 per molecule and are generally 1.

The sulfonic acids are generally petroleum sulfonic acids or synthetically prepared alkaryl sulfonic acids. Among the petroleum sulfonic acids, the most useful products are those prepared by the sulfonation of suitable petroleum fractions with a subsequent removal of acid sludge, and purification. Synthetic alkaryl sulfonic acids are prepared usually from alkylated benzenes such as the Friedel-Crafts reaction products of benzene and polymers such as tetrapropylene. The following are specific examples of sulfonic acids useful in preparing the salts (B). It is to be understood that such examples serve also to illustrate the salts of such sulfonic acids useful as component (B). In other words, for every sulfonic acid enumerated, it is intended that the corresponding basic alkali metal salts thereof are also understood to be illustrated. (The same applies to the lists of other acid materials listed below.) Such sulfonic acids include mahogany sulfonic acids, bright stock sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetra-isobutylene sulfonic acids, tetra-amylene sulfonic acids, chloro-substituted paraffin wax sulfonic acids, nitroso-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, dodecylbenzene sulfonic acids, "dimer alkylate" sulfonic acids, and the like.

Alkyl-substituted benzene sulfonic acids wherein the alkyl group contains at least 8 carbon atoms including dodecyl benzene "bottoms" sulfonic acids are particularly useful. The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of basic sulfonate salts which can be incorporated into the lubricating oil compositions of this invention as component (E), and techniques for making them can be found in the following U.S. Pat. Nos.: 2,174,110; 2,202,781; 2,239,974; 2,319,121; 2,337,552; 3,488,284; 3,595,790; and 3,798,012. These are hereby incorporated by reference for their disclosures in this regard.

Suitable carboxylic acids from which useful metal salts (B) can be prepared include aliphatic, cycloaliphatic and aromatic mono- and polybasic carboxylic acids free from acetylenic unsaturation, including naphthenic acids, alkyl- or alkenyl-substituted cyclopentanoic acids, alkyl- or alkenyl-substituted cyclohexanoic acids, and alkyl- or alkenyl-substituted aromatic carboxylic acids. The aliphatic acids generally contain from about 8 to about 50, and preferably from about 12 to about 25 carbon atoms. The cycloaliphatic and aliphatic carboxylic acids are preferred, and they can be saturated or unsaturated. Specific examples include 2-ethylhexanoic acid, linolenic acid, propylene tetramer-substituted maleic acid, behenic acid, isostearic acid, pelargonic acid, capric acid, palmitoleic acid, linoleic acid, lauric acid, oleic acid, ricinoleic acid, undecyclic acid, dioctylcyclopentanecarboxylic acid, myristic acid, dilauryldecahydronaphthalene-carboxylic acid, stearyloctahydroindenecarboxylic acid, palmitic acid, alkyl- and alkenylsuccinic acids, acids formed by oxidation of petrolatum or of hydrocarbon waxes, and commercially available mixtures of two or more carboxylic acids such as tall oil acids, rosin acids, and the like.

The equivalent weight of the acidic organic compound is its molecular weight divided by the number of acidic groups (i.e., sulfonic acid or carboxy groups) present per molecule.

The pentavalent phosphorus acids useful in the preparation of component (B) may be represented by the formula

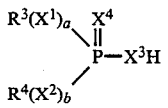

wherein each of $R^3$ and $R^4$ is hydrogen or a hydrocarbon or essentially hydrocarbon group preferably having from about 4 to about 25 carbon atoms, at least one of $R^3$ and $R^4$ being hydrocarbon or essentially hydrocarbon; each of $X^1$, $X^2$, $X^3$ and $X^4$ is oxygen or sulfur; and each of a and b is 0 or 1. Thus, it will be appreciated that the phosphorus acid may be an organophosphoric, phosphonic or phosphinic acid, or a thio analog of any of these.

The phosphorus acids may be those of the formula

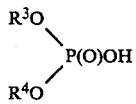

wherein $R^3$ is a phenyl group or (preferably) an alkyl group having up to 18 carbon atoms, and $R^4$ is hydrogen or a similar phenyl or alkyl group. Mixtures of such phosphorus acids are often preferred because of their ease of preparation.

Component (B) may also be prepared from phenols; that is, compounds containing a hydroxy group bound directly to an aromatic ring. The term "phenol" as used herein includes compounds having more than one hydroxy group bound to an aromatic ring, such as catechol, resorcinol and hydroquinone. It also includes alkylphenols such as the cresols and ethylphenols, and alkenylphenols. Preferred are phenols containing at least one alkyl substituent containing about 3–100 and especially about 6–50 carbon atoms, such as heptylphenol, octylphenol, dodecylphenol, tetrapropene-alkylated phenol, octadecylphenol and polybutenylphenols. Phenols containing more than one alkyl substituent may also be used, but the monoalkylphenols are preferred because of their availability and ease of production.

Also useful are condensation products of the above-described phenols with at least one lower aldehyde or ketone, the term "lower" denoting aldehydes and ketones containing not more than 7 carbon atoms. Suitable aldehydes include formaldehyde, acetaldehyde, propionaldehyde, the butyraldehydes, the valeraldehydes and benzaldehyde. Also suitable are aldehyde-yielding reagents such as paraformaldehyde, trioxane, methylol, Methyl Formcel and paraldehyde. Formaldehyde and the formaldehyde-yielding reagents are especially preferred.

The equivalent weight of the acidic organic compound is its molecular weight divided by the number of acidic groups (i.e., sulfonic acid or carboxy groups) present per molecule.

The amount of component (B) included in the lubricants of the present invention also may be varied, and useful amounts in any particular lubricating oil composition can be readily determined by one skilled in the art. Component (B) functions as a detergent. The amount of component (B) contained in a lubricant of the invention may vary from about 0.01% to about 2% or more by weight. The amount of detergent included in the oil composition is an amount which is sufficient to provide the desired detergent properties. In one preferred embodiment the amount of detergent in the oil and the amount of other metal-containing (ash-producing) components should be an amount which results in an oil having a sulfate ash content less than about 1.3% by weight. The sulfate ash content as calcium of preferred lubricating oil compositions is less than about 0.4% by weight. Most preferably, the sulfate ash content of the oils as calcium is less than 0.2% by weight and in one embodiment is about 0%.

The following examples illustrate the preparation of basic alkaline earth metal salts useful as component (B). Unless otherwise specifically indicated in the following examples and elsewhere in the specification and claims, all parts are by weight, temperatures are in degrees Celcius, and pressure is at or near atmospheric.

EXAMPLE B-1

A mixture of 906 parts of an oil solution of an alkyl phenyl sulfonic acid (having a number average molecular weight of 450, 564 parts mineral oil, 600 parts toluene, 98.7 parts magnesium oxide and 120 parts water is blown with carbon dioxide at a temperature of 78°–85° C. for 7 hours at a rate of about 3 cubic feet of carbon dioxide per hour. The reaction mixture is constantly agitated throughout the carbonation. After carbonation, the reaction mixture is stripped to 165° C./20 tor and the residue filtered. The filtrate is an oil solution (34% oil) of the desired overbased magnesium sulfonate having a metal ratio of about 3.

EXAMPLE B-2

A polyisobutenyl succinic anhydride is prepared by reacting a chlorinated poly(isobutene) (having an average chlorine content of 4.3% and derived from a polyisobutene having a number average molecular weight of about 1150) with maleic anhydride at about 200° C. To a mixture of 1246 parts of this succinic anhydride and 1000 parts of toluene there is added at 25° C., 76.6 parts of barium oxide. The mixture is heated to 115° C. and 125 parts of water is added drop-wise over a period of one hour. The mixture is then allowed to reflux at 150° C. until all the barium oxide is reacted. Stripping and filtration provides a filtrate containing the desired product.

Basic magnesium sulfonates useful in the lubricating oils of this invention are available commercially. For example, Hybase M-400 TM, available from Witco Chemical Co., is a magnesium overbased alkyl (number average molecular weight of about 500) benzene sulfonate having a metal ratio of about 13 and a total base number of 400 (45% oil).

(C) Metal Salts Other than Magnesium and Calcium.

In one embodiment, the lubricating oil compositions of the present invention also contain at least one metal salt which may be a salt of (C-1) a substituted succinic acid acylated polyamine; or (C-2) a hydrocarbon-substituted aromatic carboxylic acid containing at least one hydroxyl group attached to an aromatic ring, provided that the metal of the metal salt (C) is not calcium or magnesium.

Metal salt (C) is incorporated into the lubricating oil compositions to improve the corrosion-resistant characteristics of the lubricating oil compositions. The amount of metal salt (C) incorporated into the lubricating oil compositions will be an amount which is sufficient to provide the desired corrosion-inhibiting properties to the oil compositions. Accordingly, amounts of about 0.01% to about 5% or 10% by weight of the metal salt (C) may be included in the lubricating oil compositions.

The substituted succinic acid acylated polyamines useful as component (C-1) in the lubricating oil compositions of the present invention may be prepared by reacting at a temperature within the range of from about 20° C. to about 250° C.; (C-1-a) about two equivalents of at least one substituted succinic acylating agent consisting of substituent groups and succinic groups wherein the substituent group has a number average molecular weight of at least about 700; (C-1-b) about one equivalent of a basic metal reactant; and (C-1-c) from about 1 to about 5 equivalents of an amine compound characterized by the presence within its structure of at least one HN< group. The substituted succinic acylating agent may be prepared by the reaction of maleic anhydride with a high molecular weight olefin or chlorinated hydrocarbon or other high molecular weight hydrocarbon containing an activating polar group. The reaction can be effected at a temperature within the range of from about 100° C. to about 200° C., and the resulting product is a hydrocarbon-substituted succinic anhydride. The anhydride may be hydrolyzed to the corresponding acid by treatment with water or steam.

The basic metal reactant (C-1-b) comprises the oxides, hydroxides, carbonates, alkylates, halides and nitrates of lead, cadmium, zinc, nickel, cobalt, and alkaline earth metals other than calcium or magnesium. Specific examples of basic metal reactants which are useful in the present invention include zinc oxide, zinc hydroxide, zinc carbonate, zinc methylate, zinc propylate, zinc pentylate, zinc chloride, zinc fluoride, zinc nitrate, trinitrate, cadmium oxide, cadmium carbonate, lead carbonate, nickel carbonate, nickel hydroxide, etc. One of the preferred basic metal reactants is zinc oxide.

The amine compound (C-1-c) is generally an alkaline polyamine or a hydroxyalkyl-substituted alkaline polyamine. Any of the amines described below as being useful in the formation of the carboxylic derivative compositions (D) can be used as amine compound (C-1-c). In one embodiment, the amount of amine used in the reaction is from about 1 to 2 equivalents.

The salt of substituted succinic acid acylated polyamine (C-1) useful as one of the components in the lubricating oil compositions of the present invention are described more fully in U.S Reissue Pat. No. 26,433. This reissue patent is hereby incorporated by reference for its disclosure of such metal salts of acylated polyamines and for its description of procedures for preparing such metal salts. The preferred process for preparing the metal salts of the acid acylated polyamines involves first reacting the succinic compound with the basic metal reactant followed by reaction with the polyamine. The following examples illustrate the process of preparing a number of such acylated polyamines.

EXAMPLE C-1

A polyisobutenyl succinic anhydride is prepared by the reaction of a chlorinated polyisobutylene (having an average chlorine content of 4.3% by weight and an average of 70 carbon atoms) with maleic anhydride at about 200° C. The resulting polyisobutenyl succinic anhydride has an acid number of 103. To a mixture of 3.264 grams (6 equivalents) of this polyisobutenyl succinic anhydride, 2420 grams of mineral oil and 75 grams of water, there is added at 80°-100° C., 122.1 grams (3 equivalents) of zinc oxide. The addition is made portionwise over a period of 30 minutes. The mixture is maintained at a temperature of 90°-100° C. for a period of 3 hours. Thereupon, the mixture is heated to 150° C. and maintained at this temperature until it is essentially dry. The mixture is cooled to 100° C. and there is added 245 grams (6 equivalents) of an ethylene polyamine mixture having an average composition corresponding to that of tetraethylene pentamine and an equivalent weight of 40.8. The addition is made portionwise over a period of 30 minutes whereupon the mixture is heated to a temperature of 150°-160° C. and maintained at this temperature for 5 hours. Throughout the 5-hour period, nitrogen is bubbled through the mixture to remove water formed as a result of acylation. The residue is filtered. The resulting filtrate has a zinc content of 1.63% and a nitrogen content of 1.39%.

EXAMPLE C-2

To a mixture of 3330 grams (6 equivalents) of a polyisobutenyl succinic anhydride (having an acid number of 101 and prepared, as in Example C-1, from maleic anhydride and chlorinated polyisobutylene having an average chlorine content of 4.3% by weight and an average of 71 carbon atoms), 2386 grams of mineral oil and 75 grams of water, there is added, at 80°-90° C., 122 grams (3 equivalents) of zinc oxide. The addition is made portionwise over a 30-minute period. The mixture is maintained at a temperature of 90°-105° C. for 4 hours. Thereupon, 122 grams (3 equivalents) of the amine mixture described in Example C-1 is added portionwise over a period of 30 minutes while the temperature of the mixture is maintained at 105°-110° C. The mixture is heated at 205°-215° C., and maintained at this temperature for 4 hours. Throughout the 4-hour period, nitrogen is bubbled through the mixture to remove water formed as a result of acylation. The residue is filtered. The resulting filtrate has a zinc content of 1.64% and a nitrogen content of 0.72%.

EXAMPLE C-3

To a mixture of 1028 grams (2 equivalents) of a polyisobutenyl succinic anhydride (having an acid number of 109 and prepared, as in Example C-1, from maleic anhydride and a chlorinated polyisobutylene having an average chlorine content of 4.3% by weight and an average of 65 carbon atoms), 707 grams of mineral oil and 1500 grams of benzene, there is added at 60° C., 41 grams (1 equivalent) of an amine mixture such as described in Example 1 (but with an equivalent weight of 41). The addition is made portionwise over a 30-minute period. The mixture is maintained at a temperature of 85°-90° C. for 7 hours. Throughout this 7-hour period, nitrogen is bubbled through the mixture to remove water resulting from acylation. To 1034 grams of the above mixture and 52 grams of water, there is added at 80°-90° C., 52 grams (0.67 equivalent) of barium oxide. The addition is made portionwise over a 30-minute period. The mixture is maintained at a temperature of 80°-90° C. for 2 hours. Thereupon, the mixture is heated to 150° C. and stripped of the last traces of water. The residue is filtered. The filtrate has a barium content of 3.9% and a nitrogen content of 0.76%.

EXAMPLE C-4

To a mixture of 3620 grams (7 equivalents) of a polyisobutenyl succinic anhydride (having an acid number of 108 and prepared, as in Example C-1, from maleic anhydride and chlorinated polyisobutylene having an average chlorine content of 4.3% by weight and an average of 66 carbon atoms) and 2490 grams of mineral oil, there is added at 60°-80° C., 143 grams (3.5 equivalents) of an amine mixture such as described in Example C-1 (but with an equivalent weight of 40.7). The addition is made portionwise over a 1-hour period. The mixture is maintained at a temperature of 150°-155° C. for 5 hours throughout which period nitrogen is bubbled through the mixture to remove water resulting from acylation. To 2170 grams of the above mixture, 84 grams of water, and 46 grams of mineral oil, there is added at 60°-80° C., 84 grams (1.1 equivalents) of barium oxide. The addition is made portionwise over a 30-minute period. The mixture is maintained at a temperature of 80°-90° C. for 2 hours whereupon the mixture is heated to 150° C. and stripped of the last traces of water. The residue is filtered. The filtrate has a barium content of 3% and a nitrogen content of 0.76%.

EXAMPLE C-5

To a mixture of 524 grams (1 equivalent) of a polysiobutenyl succinic anhydride (having an acid number of 107 and prepared, as in Example C-1, from maleic anhydride and chlorinated polyisobutylene having an average chlorine content of 4.3% by weight and an average of 66 carbon atoms), 500 grams of toluene and 10 grams of water, there is added at 80° C., 20 grams (0.5 equivalent) of sodium hydroxide. The addition is made portionwise over a period of 15 minutes. The mixture is maintained at a temperature of 80°-85° C. for 1 hour and the mixture then is dried by heating at 110°-115° C. for 1 hour. Then 59.3 grams (0.5 equivalent) of nickel chloride hexahydrate is added portionwise over a period of 30 minutes, at 80°-90° C. This temperature is maintained for 6 hours, then the mixture is heated at 115°-120° C. for 6 hours. The mixture is filtered and the filtrate treated with 306 grams of mineral oil and 17.8 grams (0.44 equivalent) of an amine mixture such as described in Example C-1. The resulting mixture is heated at 150°-160° C. for 3.5 hours, during which time nitrogen is bubbled through the mixture to remove water resulting from acylation. The residue is filtered. The filtrate has a nickel content of 0.69% and a nitrogen content of 0.82%.

EXAMPLE C-6

To a mixture of 990 grams (2 equivalents) of a polyisobutenyl succinic anhydride (having an acid number of 113 and prepared, as in Example C-1, from maleic anhydride and chlorinated polyisobutylene having an average chlorine content of 4.3% by weight and an average of 62 carbon atoms), 694 grams of mineral oil and 20 grams of water, there is added at 30° C., 69 grams (1 equivalent) of potassium carbonate. The addition is made portionwise over a period of 15 minutes. The mixture is heated at 85°-95° C. for 1 hour and then dried by heating at 135°-145° C./50 mm for 1 hour. Thereupon, 160 grams (1 equivalent) of cobaltous nitrate hexahydrate is added portionwise over a period of 45 minutes while the temperature of the mixture is maintained at 90°-95° C. The mixture then is heated at 130°-150° C. for 9 hours and filtered. The filtrate is treated with 66 grams (1 equivalent) of an amine mixture of poly(trimethylene)polyamines comprising mostly N,N-di(3-aminopropyl)-N'(3-aminopropyl)-1,3-propanediamine and having an average molecular weight of 180 and a base number of 852. The addition is made portionwise over a 30-minute period while the temperature is maintained at 120°-125° C. The mixture is then heated at 175°-185° C. for 4 hours throughout which period nitrogen is bubbled into the mixture to remove water resulting from acylation. The residue is filtered. The filtrate has a cobalt content of 1.34% and a nitrogen content of 0.66%.

The metal salts (C) may also be (C-2) salts of hydrocarbon-substituted aromatic carboxylic acids containing at least one hydroxyl group attached to an aromatic ring provided that the metal of said salt is not calcium or magnesium. The aromatic group of the aromatic carboxylic acid includes aromatic groups such as those derived from benzene, napthalene, anthracene, phenanthrene, biphenyl, etc. Generally, the aromatic group is derived from benzene or naphthalene. In a preferred embodiment, the aromatic carboxylic acid containing a hydroxy group is of the type represented by Formula III

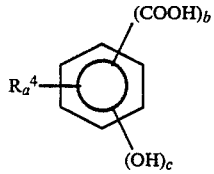

(III)

wherein $R^4$ is an aliphatic hydrocarbyl group, a is a number in the range of from 0 to about 4, b is a number in the range of from 1 to about 4, c is a number in the range of from 1 to about 4 with the proviso that the sum of a, b and c does not exceed 6. In a more preferred embodiment, $R^4$ is an aliphatic hydrocarbyl group containing from about 4 to about 400 carbon atoms, a is from 1 to about 3, b is from 1 to about 2, c is 1 or 2 with the proviso that the sum of a, b and c does not exceed 6. Preferably, $R^4$ and a are such that the aromatic carboxylic acid contains at least an average of about 12 aliphatic carbon atoms in the aliphatic hydrocarbon substituent per acid group.

Particularly useful as the aromatic carboxylic acids containing hydroxyl groups are the aliphatic hydrocarbon-substituted salicyclic acids wherein each aliphatic hydrocarbon substituent contains an average of at least about 8 carbon atoms per substituent, and the molecule contains from 1 to 3 substituents. Salicyclic acids were in the aliphatic hydrocarbon substituents are derived from polymerized olefins, particularly polymerized lower 1-monoolefins such as polyethylene, polypropylene, polyisobutylene, etc., and having average carbon contents of about 30 to about 400 carbon atoms are particularly useful.

The aromatic carboxylic acids corresponding to Formula III above are well known and can be prepared according to procedures known in the art. Carboxylic acids of this type, and processes for preparing their metal salts are well known and disclosed in U.S. Pat. Nos. 2,197,832; 2,252,662; 3,410,798; and 3,595,791.

(D) Carboxylic Derivative Compositions.

The lubricating oil compositions of the present invention also may contain (D) at least one carboxylic derivative composition produced by reacting (D-1) at least one substituted succinic acylating agent with (D-2) a reactant selected from the group consisting of at least one amine compound characterized by the presence within its structure of at least one HN< group; at least one alcohol; or mixtures of said amines and alcohols. The choice of particular carboxylic derivative composition or compositions generally will depend upon the intended use of the lubricant, that is, whether the lubricant is to be used in a gasoline-fueled engine, an alcohol-fueled engine or a flexible- or variable-fuel engine capable of operating on gasoline and alcohol fuels. Thus, the carboxylic derivative contained in the lubricant may be one derived by reacting the substituted succinic acylating agent with an amine or a polyamine, or the derivative may be one derived from the reaction of a succinic acylating agent with an alcohol, or the lubricant may contain both types of carboxylic derivatives.

The substituted succinic acylating agents (D-1) which are used in the preparation of the carboxylic derivatives useful in the lubricating oil compositions of the present invention may be characterized by the presence within their structure of two groups or moieties. The first group or moiety is referred to hereinafter, for convenience, as the "substituent group(s)" and is derived from a polyalkene. The polyalkene from which the substituent is derived has a number average molecular weight ($\overline{M}n$) of at least about 700, and number average molecular weights of from about 700 to about 5000 are preferred.

In one preferred embodiment, the polyalkene from which the substituted groups are derived is characterized by an $\overline{M}n$ value of from about 1300 to about 5000, and an $\overline{M}w/\overline{M}n$ value of at least about 1.5 and more generally from about 1.5 to about 4.5 or about 1.5 to about 4.0. The abbreviation $\overline{M}w$ is the conventional symbol representing weight average molecular weight, and $\overline{M}n$ is the conventional symbol representing number average molecular weight. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC.

The techniques for determining $\overline{M}n$ and $\overline{M}w$ values of polymers are well known and are described in numerous books and articles. For example, methods for the determination of $\overline{M}n$ and molecular weight distribution of polymers is described in W. W. Yan, J. J. Kirkland and D. D. Bly, "Modern Size Exclusion Liquid Chromatographs", J. Wiley & Sons, Inc., 1979.

The second group or moiety in the acylating agent is referred to herein as the "succinic group(s)". The succinic groups are those groups characterized by the structure

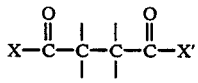

(IV)

wherein X and X' are the same or different provided at least one of X and X' is such that the substituted succinic acylating agent can function as carboxylic acylating agents. That is, at least one of X and X' must be such that the substituted acylating agent can form amides or amine salts with amino compounds, and otherwise function as a conventional carboxylic acid acylating agents. Transesterification and transamidation reactions are considered, for purposes of this invention, as conventional acylating reactions.

Thus, X and/or X' is usually —OH, —O-hydrocarbyl, —O—M+ where M+ represents one equivalent of a metal, ammonium or amine cation, —$NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C(O)X and —C(O)X' can enter into acylation reactions.

One of the unsatisfied valences in the grouping

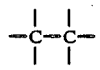

of formula IV forms a carbon-to-carbon bond with a carbon atom in the substituent group. While other such unsatisfied valence may be satisfied by a similar bond with the same or different substituent group, all but the said one such valence is usually satisfied by hydrogen; i.e., —H.

The substituted succinic acylating agents are characterized by the presence within their structure of an average of at least 1.3 succinic groups (that is, groups corresponding to Formula IV) for each equivalent weight of substituent groups. For purposes of this invention, the equivalent weight of substituent groups is deemed to be the number obtained by dividing the Mn value of the polyalkene from which the substituent is derived into the total weight of the substituent groups present in the substituted succinic acylating agents. Thus, if a substituted succinic acylating agent is characterized by a total weight of substituent group of 40,000, and the $\overline{M}n$ value for the polyalkene from which the substituent groups are derived is 2000, then that substituted succinic acylating agent is characterized by a total of 20 (40,000/2000=20) equivalent weights of substituent groups. Therefore, that particular succinic acylating agent or succinic acylating agent mixture must also be characterized by the presence within its structure of at least 26 succinic groups to meet one of the requirements of the succinic acylating agents used in this invention.

The ratio of succinic groups to the equivalent weight of substituent group present in the acylating agent can be determined from the saponification number of the reacted mixture corrected to account for unreacted polyalkene present in the reaction mixture at the end of the reaction (generally referred to as filtrate or residue in the following examples). Saponification number is determined using the ASTM D-94 procedure. The formula for calculating the ratio from the saponification number is as follows:

$$\text{Ratio} = \frac{(\overline{M}n)(\text{Sap No., corrected})}{112{,}200-98(\text{Sap No., corrected})}$$

The corrected saponification number is obtained by dividing the saponification number by the percent of the polyalkene that has reacted. For example, if 10% of the polyalkene did not react and the saponification number of the filtrate or residue is 95, the corrected saponification number is 95 divided by 0.90 or 105.5.

Another requirement for the substituted succinic acylating agents is that the substituent groups must have been derived from a polyalkene characterized by an $\overline{M}w/\overline{M}n$ value of at least about 1.5. The upper limit of $\overline{M}w/\overline{M}n$ will generally be about 4.5. Values of from 1.5 to about 4.0 are particularly useful.

Polyalkenes having the Mn and Mw values discussed above are known in the art and can be prepared according to conventional procedures. For example, some of these polyalkenes are described and exemplified in U.S. Pat. No. 4,234,435, and the disclosure of this patent relative to such polyalkenes is hereby incorporated by reference. Several such polyalkenes, especially polybutenes, are commercially available.

In one preferred embodiment, the succinic groups will normally correspond to the formula

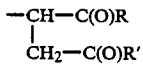

(V)

wherein R and R′ are each independently selected from the group consisting of —OH, —Cl, —O-lower alkyl, and when taken together, R and R′ are —O—. In the latter case, the succinic group is a succinic anhydride group. All the succinic groups in a particular succinic acylating agent need not be the same, but they can be the same. Preferably, the succinic groups will correspond to

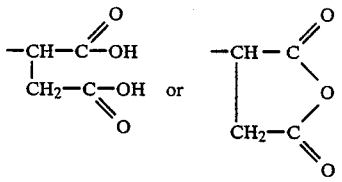

(VI)

(A) (B)

and mixtures of (VI(A)) and (VI(B)). Providing substituted succinic acylating agents wherein the succinic groups are the same or different is within the ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

As previously mentioned, the minimum number of succinic groups for each equivalent weight of substituent group in the substituted succinic acylating agent is 1.3. The maximum number generally will not exceed about 4. Generally the minimum will be about 1.4 succinic groups for each equivalent weight of substituent group. A narrower range based on this minimum is at least about 1.4 to about 3.5, and more specifically about 1.4 to about 2.5 succinic groups per equivalent weight of substituent groups.

In addition to preferred substituted succinic groups where the preference depends on the number and identity of succinic groups for each equivalent weight of substituent groups, still further preferences are based on the identity and characterization of the polyalkenes from which the substituent groups are derived.

With respect to the value of $\overline{M}n$ for example, a minimum of about 1300 and a maximum of about 5000 are preferred with an $\overline{M}n$ value in the range of from about 1500 to about 5000 also being preferred. A more preferred $\overline{M}n$ value is one in the range of from about 1500 to about 2800. A most preferred range of $\overline{M}n$ values is from about 1500 to about 2400.

Before proceeding to a further discussion of the polyalkenes from which the substituent groups are derived, it should be pointed out that these preferred characteristics of the succinic acylating agents are intended to be understood as being both independent and dependent. They are intended to be independent in the sense that, for example, a preference for a minimum of 1.4 or 1.5 succinic groups per equivalent weight of substituent groups is not tied to a more preferred value of $\overline{M}n$ or $\overline{M}w/\overline{M}n$. They are intended to be dependent in the sense that, for example, when a preference for a minimum of 1.4 or 1.5 succinic groups is combined with more preferred values of $\overline{M}n$ and/or $\overline{M}w/\overline{M}n$, the combination of preferences does in fact describe still further more preferred embodiments of the invention. Thus, the various parameters are intended to stand alone with respect to the particular parameter being discussed but can also be combined with other parameters to identify further preferences. This same concept is intended to apply throughout the specification with respect to the description of preferred values, ranges, ratios, reactants, and the like unless a contrary intent is clearly demonstrated or apparent.

In one embodiment, when the $\overline{M}n$ of a polyalkene is at the lower end of the range, e.g., about 1300, the ratio of succinic groups to substituent groups derived from said polyalkene in the acylating agent is preferably higher than the ratio when the $\overline{M}n$ is, for example, 1500. Conversely when the $\overline{M}n$ of the polyalkene is higher, e.g., 2000, the ratio may be lower than when the $\overline{M}n$ of the polyalkene is, e.g., 1500.

The polyalkenes from which the substituent groups are derived are homopolymers and interpolymers of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)" as used herein is inclusive of copolymers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., $>C{=}C<$); that is, they are monoolefinic monomers such as ethylene, propylene, butene-1, isobutene, and octene-1 or polyolefinic monomers (usually diolefinic monomers) such as butadiene-1,3 and isoprene.

These olefin monomers are usually polymerizable terminal olefins; that is, olefins characterized by the presence in their structure of the group $>C{=}CH_2$. However, polymerizable internal olefin monomers (sometimes referred to in the literature as medial olefins) can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin.

Thus, pentadiene-1,3 (i.e., piperylene) is deemed to be a terminal olefin for purposes of this invention.

Some of the substituted succinic acylating agents (D-1) useful in preparing the carboxylic derivatives (D) and methods for preparing such substituted succinic acylating agents are known in the art and are described in, for example, U.S. Pat. No. 4,234,435, the disclosure of which is hereby incorporated by reference. The acylating agents described in the '435 patent are characterized as containing substituent groups derived from polyalkenes having an $\overline{M}n$ value of about 1300 to about 5000, and an $\overline{M}w/\overline{M}n$ value of about 1.5 to about 4. In addition to the acylating agents described in the '435 patent, the acylating agents (D-1) useful in the present invention may contain substituent groups derived from polyalkenes having an $\overline{M}w/\overline{M}n$ ratio of up to about 4.5.

There is a general preference for aliphatic, hydrocarbon polyalkenes free from aromatic and cycloaliphatic groups. Within this general preference, there is a further preference for polyalkenes which are derived from the group consisting of homopolymers and interpolymers of terminal hydrocarbon olefins of 2 to about 16 carbon atoms. This further preference is qualified by the proviso that, while interpolymers of terminal olefins are usually preferred, interpolymers optionally containing up to about 40% of polymer units derived from internal olefins of up to about 16 carbon atoms are also within a preferred group. A more preferred class of polyalkenes are those selected from the group consisting of homopolymers and interpolymers of terminal olefins of 2 to about 6 carbon atoms, more preferably 2 to 4 carbon atoms. However, another preferred class of polyalkenes are the latter more preferred polyalkenes optionally containing up to about 25% of polymer units derived from internal olefins of up to about 6 carbon atoms.

Specific examples of terminal and internal olefin monomers which can be used to prepare the polyalkenes according to conventional, well-known polymerization techniques include ethylene; propylene; butene-1; butene-2; isobutene; pentene-1; hexene-1; heptene-1; octene-1; nonene-1; decene-1; pentene-2; propylene-tetramer; diisobutylene; isobutylene trimer; butadiene-1,2; butadiene-1,3; pentadiene-1,2; pentadiene-1,3; pentadiene-1,4; isoprene; hexadiene-1,5; 2-chloro-butadiene-1,3; 2-methyl-heptene-1; 3-cyclohexylbutene-1; 2-methylpentene-1; styrene; 2,4-dichloro styrene; divinylbenzene; vinyl acetate; allyl alcohol; 1-methyl-vinyl acetate; acrylonitrile; ethyl acrylate; methyl methacrylate; ethyl vinyl ether; and methyl vinyl ketone. Of these, the hydrocarbon polymerizable monomers are preferred and of these hydrocarbon monomers, the terminal olefin monomers are particularly preferred.

Specific examples of polyalkenes include polypropylenes, polybutenes, ethylene-propylene copolymers, styrene-isobutene copolymers, isobutene-butadiene-1,3 copolymers, propene-isoprene copolymers, isobutene-chloroprene copolymers, isobutene-(paramethyl)styrene copolymers, copolymers of hexene-1 with hexadiene-1,3, copolymers of octene-1 with hexene-1, copolymers of heptene-1 with pentene-1, copolymers of 3-methyl-butene-1 with octene-1, copolymers of 3,3-dimethyl-pentene-1 with hexene-1, and terpolymers of isobutene, styrene and piperylene. More specific examples of such interpolymers include copolymer of 95% (by weight) of isobutene with 5% (by weight) of styrene; terpolymer of 98% of isobutene with 1% of piperylene and 1% of chloroprene; terpolymer of 95% of isobutene with 2% of butene-1 and 3% of hexene-1; terpolymer of 60% of isobutene with 20% of pentene-1 and 20% of octene-1; copolymer of 80% of hexene-1 and 20% of heptene-1; terpolymer of 90% of isobutene with 2% of cyclohexene and 8% of propylene; and copolymer of 80% of ethylene and 20% of propylene. A preferred source of polyalkenes are the poly(isobutene)s obtained by polymerization of $C_4$ refinery stream having a butene content of about 35% to about 75% by weight and an isobutene content of about 30% to about 60% by weight in the presence of a Lewis acid catalyst such as aluminum trichloride or boron trifluoride. These polybutenes contain predominantly (greater than about 80% of the total repeating units) of isobutene (or isobutylene) repeating units of the configuration

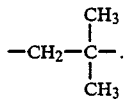

Obviously, preparing polyalkenes as described above which meet the various criteria for Mn and Mw/Mn is within the skill of the art and does not comprise part of the present invention. Techniques readily apparent to those in the art include controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

In preparing the substituted succinic acylating agents (D-1), one or more of the above-described polyalkenes is reacted with one or more acidic reactants selected from the group consisting of maleic or fumaric reactants of the general formula $$X(O)C—CH=CH—C(O)X' \quad \text{(VII)}$$

wherein X and X' are as defined hereinbefore in Formula IV. Preferably the maleic and fumaric reactants will be one or more compounds corresponding to the formula $$RC(O)—CH=CH—C(O)R' \quad \text{(VIII)}$$

wherein R and R' are as previously defined in Formula V herein. Ordinarily, the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents of the present invention. The especially preferred reactants are maleic acid, maleic anhydride, and mixtures of these. Due to availability and ease of reaction, maleic anhydride will usually be employed.

The one or more polyalkenes and one or more maleic or fumaric reactants can be reacted according to any of several known procedures in order to produce the substituted succinic acylating agents of the present invention. Basically, the procedures are analogous to procedures used to prepare the higher molecular weight succinic anhydrides and other equivalent succinic acylating analogs thereof except that the polyalkenes (or poly-olefins) of the prior art are replaced with the particular polyalkenes described above and the amount of maleic or fumaric reactant used must be such that there is an average of at least 1.3 succinic groups for each equivalent weight of the substituent group in the final substituted succinic acylating agent produced. Examples of patents describing various procedures by preparing acylating agents include U.S. Pat. Nos. 3,215,707 (Rense); 3,219,666 (Norman et al); 3,231,587 (Rense); 3,912,764 (Palmer); 4,110,349 (Cohen); and 4,234,435 (Meinhardt et al); and U.K. No. 1,440,219. The disclosures of these patents are hereby incorporated by reference.

For convenience and brevity, the term "maleic reactant" is often used hereinafter. When used, it should be understood that the term is generic to acidic reactants selected from maleic and fumaric reactants corresponding to Formulae (VII) and (VIII) above including a mixture of such reactants.

One procedure for preparing the substituted succinic acylating agents (D-1) is illustrated, in part, in U.S. Pat. No. 3,219,666 (Norman et al) which is expressly incorporated herein by reference for its teachings in regard to preparing succinic acylating agents. This procedure is conveniently designated as the "two-step procedure". It involves first chlorinating the polyalkene until there is an average of at least about one chloro group for each molecular weight of polyalkene. The second step in the two-step chlorination procedure is to react the chlorinated polyalkene with the maleic reactant at a temperature usually within the range of about 100° C. to about 200° C. The mole ratio of chlorinated polyalkene to maleic reactant is usually at least about 1:1.3.

One preferred process for preparing the substituted acylating agents comprises heating and contacting at a temperature of at least about 140° C. up to the decomposition temperature, (A) Polyalkene characterized by Mn value of about 1300 to about 5000 and an Mw/Mn value of about 1.5 to about 6, (B) One or more acidic reactants of the formula $$XC(O)—CH{=}CH—C(O)X'$$

wherein X and X' are as defined hereinbefore, and (C) Chlorine wherein the mole ratio of (A):(B) is such that there is at least about 1.3 moles of (B) for each mole of (A) wherein the number of moles of (A) is the quotient of the total weight of (A) divided by the value of $\overline{Mn}$ and the amount of chlorine employed is such as to provide at least about 0.2 mole (preferably at least about 0.5 mole) of chlorine for each mole of (B) to be reacted with (A), said substituted acylating compositions being characterized by the presence within their structure of an average of at least 1.3 groups derived from (B) for each equivalent weight of the substituent groups derived from (A).

The terminology "substituted succinic acylating agent(s)" is used herein in describing the substituted succinic acylating agents regardless of the process by which they are produced. On the other hand, the terminology "substituted acylating composition(s)", may be used to describe the reaction mixtures produced by the specific preferred processes described in detail herein. Thus, the identity of particular substituted acylating compositions is dependent upon a particular process of manufacture. This is particularly true because, while the products of this invention are clearly substituted succinic acylating agents as defined and discussed above, their structure cannot be represented by a single specific chemical formula. In fact, mixtures of products are inherently present. For purposes of brevity, the terminology "acylating reagent(s)" is often used hereinafter to refer, collectively, to both the substituted succinic acylating agents and to the substituted acylating compositions.

The acylating reagents described above are intermediates in processes for preparing the carboxylic derivative compositions (D). In one embodiment the derivatives are prepared by reacting one or more acylating agents (D-1) with at least one amine compound (D-2) characterized by the presence within its structure of at least one HN< group.

The amino compound (D-2) characterized by the presence within its structure of at least one HN< group can be a monoamine or polyamine compound. Mixtures of two or more amino compounds can be used in the reaction with one or more acylating reagents of this invention. Preferably, the amino compound contains at least one primary amino group (i.e., $—NH_2$) and more preferably the amine is a polyamine, especially a polyamine containing at least two —NH— groups, either or both of which are primary or secondary amines. The amines may be aliphatic, cycloaliphatic, aromatic or heterocyclic amines. The polyamines not only result in carboxylic acid derivative compositions which are usually more effective as dispersant/detergent additives, relative to derivative compositions derived from monoamines, but these preferred polyamines result in carboxylic derivative compositions which exhibit more pronounced V.I. improving properties.

The monoamines and polyamines must be characterized by the presence within their structure of at least one HN< group. Therefore, they have at least one primary (i.e., $H_2N—$) or secondary amino (i.e., HN=) group. The amines can be aliphatic, cycloaliphatic, aromatic, or heterocyclic, including aliphatic-substituted cycloaliphatic, aliphatic-substituted aromatic, aliphatic-substituted heterocyclic, cycloaliphatic-substituted aliphatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted alicyclic, and heterocyclic-substituted aromatic amines and may be saturated or unsaturated. The amines may also contain non-hydrocarbon substituents or groups as long as these groups do not significantly interfere with the reaction of the amines with the acylating reagents of this invention. Such non-hydrocarbon substituents or groups include lower alkoxy, lower alkyl mercapto, nitro, interrupting groups such as —O— and —S— (e.g., as in such groups as $—CH_2—$ $CH_2—X—CH_2CH_2—$ where X is —O— or —S—).

With the exception of the branched polyalkylene polyamine, the polyoxyalkylene polyamines, and the high molecular weight hydrocarbyl-substituted amines described more fully hereafter, the amines ordinarily contain less than about 40 carbon atoms in total and usually not more than about 20 carbon atoms in total.

Aliphatic monoamines include mono-aliphatic and di-aliphatic substituted amines wherein the aliphatic groups can be saturated or unsaturated and straight or branched chain. Thus, they are primary or secondary aliphatic amines. Such amines include, for example, mono- and di-alkyl-substituted amines, mono- and di-alkenyl-substituted amines, and amines having one N-alkenyl substituent and one N-alkyl substituent and the like. The total number of carbon atoms in these aliphatic monoamines will, as mentioned before, normally not exceed about 40 and usually not exceed about 20 carbon atoms. Specific examples of such monoamines include ethylamine, diethylamine, n-butylamine, di-n-butylamine, allylamine, isobutylamine, cocoamine, stearylamine, laurylamine, methyllaurylamine, oleylamine, N-methyl-octylamine, dodecylamine, octadecylamine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenethylamine, and 3-(furylpropyl) amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexylamines and phenyl-substituted cyclopentylamines.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di(-paramethylphenyl) amine, naphthylamine, N-(n-butyl-)aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, and thien-yl-substituted aniline.

Polyamines are aliphatic, cycloaliphatic and aromatic polyamines analogous to the monoamines described above except for the presence within their structure of additional amino nitrogens. The additional amino nitrogens can be primary, secondary or tertiary amino nitrogens. Examples of such polyamines include N-aminopropyl-cyclohexylamines, N,N'-di-n-butyl-para-phenylene diamine, bis-(para-aminophenyl)methane, 1,4-diaminocyclohexane, and the like.

Heterocycic mono- and polyamines can also be used in making the carboxylic derivative compositions (D). As used herein, the terminology "heterocyclic mono- and polyamine(s)" is intended to describe those heterocyclic amines containing at least one primary or secondary amino group and at least one nitrogen as a heteroatom in the heterocyclic ring. However, as long as there is present in the heterocyclic mono- and polyamines at least one primary or secondary amino group, the hetero-N atom in the ring can be a tertiary amino nitrogen; that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain hetero atoms other than nitrogen, especially oxygen and sulfur. Obviously they can contain more than one nitrogen hetero atom. The five- and six-membered heterocyclic rings are preferred.

Among the suitable heterocyclics are aziridines, azetidines, azolidines, tetra- and di-hydro pyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-di-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-di-aminoethylpiperazine.

Hydroxy-substituted mono- and polyamines, analogous to the mono- and polyamines described above are also useful in preparing the carboxylic derivative (D) provided they contain at least one primary or secondary amino group. Hydroxy-substituted amines having only tertiary amino nitrogen such as in tri-hydroxyethyl amine, are thus excluded as amine reactants but can be used as alcohols in preparing component (D) as disclosed hereinafter. The hydroxy-substituted amines contemplated are those having hydroxy substituents bonded directly to a carbon atom other than a carbonyl carbon atom; that is, they have hydroxy groups capable of functioning as alcohols. Examples of such hydroxy-substituted amines include ethanolamine, di-(3-hydroxypropyl)-amine, 3-hydroxybutyl-amine, 4-hydroxybutylamine, diethanolamine, di-(2-hydroxypropyl)-amine, N-(hydroxypropyl)-propylamine, N-(2-hydroxyethyl)-cyclohexylamine, 3-hydroxycyclopentylamine, para-hydroxyaniline, N-hydroxyethyl piperazine, and the like.

Hydrazine and substituted hydrazine can also be used. At least one of the nitrogens in the hydrazine must contain a hydrogen directly bonded thereto. Preferably there are at least two hydrogens bonded directly to hydrazine nitrogen and, more preferably, both hydrogens are on the same nitrogen. The substituents which may be present on the hydrazine include alkyl, alkenyl, aryl, aralkyl, alkaryl, and the like. Usually, the substituents are alkyl, especially lower alkyl, phenyl, and substituted phenyl such as lower alkoxy substituted phenyl or lower alkyl substituted phenyl. Specific examples of substituted hydrazines are methylhydrazine, N,N-dimethyl-hydrazine, N,N'-dimethylhydrazine, phenylhydrazine, N-phenyl-N'-ethylhydrazine, N-(para-tolyl)-N'-(n-butyl)-hydrazine, N-(para-nitrophenyl)-hydrazine, N-(para-nitrophenyl)-N-methyl-hydrazine, N,N'-di(para-chlorophenol)-hydrazine, N-phenyl-N'-cyclohexylhydrazine, and the like.

The high molecular weight hydrocarbyl amines, both mono-amines and polyamines, which can be used are generally prepared by reacting a chlorinated polyolefin having a molecular weight of at least about 400 with ammonia or amine. Such amines are known in the art and described, for example, in U.S. Pat. Nos. 3,275,554 and 3,438,757, both of which are expressly incorporated herein by reference for their disclosure in regard to how to prepare these amines. All that is required for use of these amines is that they possess at least one primary or secondary amino group.

Suitable amines also include polyoxyalkylene polyamines, e.g., polyoxyalkylene diamines and polyoxyalkylene triamines, having average molecular weights ranging from about 200 to 4000 and preferably from about 400 to 2000. Illustrative examples of these polyoxyalkylene polyamines may be characterized by the formulae $$NH_2\text{-Alkylene}(\text{O-Alkylene})_m NH_2 \quad \text{(IX)}$$

wherein m has a value of about 3 to 70 and preferably about 10 to 35.

$$R(\text{Alkylene}(\text{O-Alkylene})_n NH_2)_{3-6} \quad \text{(X)}$$

wherein n is such that the total value is from about 1 to 40 with the proviso that the sum of all of the n's is from about 3 to about 70 and generally from about 6 to about 35 and R is a polyvalent saturated hydrocarbon radical of up to 10 carbon atoms having a valence of 3 to 6. The alkylene groups may be straight or branched chains and contain from 1 to 7 carbon atoms and usually from 1 to 4 carbon atoms. The various alkylene groups present within Formulae (IX) and (X) may be the same or different.

The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403, etc.".

U.S. Pat. Nos. 3,804,763 and 3,948,800 are expressly incorporated herein by reference for their disclosure of such polyoxyalkylene polyamines and process for acylating them with carboxylic acid acylating agents which processes can be applied to their reaction with the acylating reagents used in this invention.

The most preferred amines are the alkylene polyamines, including the polyalkylene polyamines. The alkylene polyamines include those conforming to the formula $$R^3-\underset{\underset{R^3}{|}}{N}-(U-\underset{\underset{R^3}{|}}{N})_n-R^3 \quad \text{(XI)}$$

wherein n is from 1 to about 10; each $R^3$ is independently a hydrogen atom, a hydrocarbyl group or a hydroxy-substituted or an amine-substituted hydrocarbyl group having up to about 30 atoms, or two $R^3$ groups on different nitrogen atoms can be joined together to form a U group with the proviso that at least one $R^3$ group is a hydrogen atom and U is an alkylene group of about 2 to about 10 carbon atoms. Preferably U is ethylene or propylene. Especially preferred ar the alkylene polyamines amines where each $R^3$ is independently hydrogen or an amino-substituted hydrocarbyl group with the ethylene polyamines and mixtures of ethylene polyamines being the most preferred. Usually n will have an average value of from about 2 to about 7. Such alkylene polyamines include methylene polyamine, ethylene polyamines, butylene polyamines, propylene polyamines, pentylene polyamines, hexylene polyamines, heptylene polyamines, etc. The higher homologs of such amines and related amino alkyl-substituted piperazines are also included.

Alkylene polyamines useful in preparing the carboxylic derivative compositions (D) include ethylene diamine, triethylene tetramine, propylene diamine, trimethylene diamine, hexamethylene diamine, decamethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene)triamine, N-(2-aminoethyl)piperazine, 1,4-bis(2-aminoethyl)piperazine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines. The mixtures are particularly useful in preparing the carboxylic derivatives (D) useful in this invention. On the other hand, quite satisfactory products can also be obtained by the use of pure alkylene polyamines.

Other useful types of polyamine mixtures are those resulting from stripping of the polyamine mixtures described above. In this instance, lower molecular weight polyamines and volatile contaminants are removed from an alkylene polyamine mixture to leave as residue what is often termed "polyamine bottoms". In general, alkylene polyamine bottoms can be characterized as having less than two, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Texas designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

These alkylene polyamine bottoms can be reacted solely with the acylating agent, in which case the amino reactant consists essentially of alkylene polyamine bottoms, or they can be used with other amines and polyamines, or alcohols or mixtures thereof. In these latter cases at least one amino reactant comprises alkylene polyamine bottoms.

Other polyamines (D-2) which can be reacted with the acylating agents (D-1) in accordance with this invention are described in, for example, U.S. Pat. Nos. 3,219,666 and 4,234,435, and these patents are hereby incorporated by reference for their disclosures of amines which can be reacted with the acylating agents described above to form the carboxylic derivatives (D) used in this invention.

Hydroxylalkyl alkylene polyamines having one or more hydroxyalkyl substituents on the nitrogen atoms, are also useful in preparing derivatives of the aforedescribed olefinic carboxylic acids. Preferred hydroxylalkyl-substituted alkylene polyamines are those in which the hydroxyalkyl group is a lower hydroxyalkyl group, i.e., having less than eight carbon atoms. Examples of such hydroxyalkyl-substituted polyamines include N-(2-hydroxyethyl)ethylene diamine,N,N-bis(2-hydroxyethyl) ethylene diamine, 1-(2-hydroxyethyl) piperazine, monohydroxypropyl-substituted diethylene triamine, dihydroxypropyl-substituted tetraethylene pentamine, N-(2-hydroxybutyl)tetramethylene diamine, etc. Higher homologs as are obtained by condensation of the above-illustrated hydroxy alkylene polyamines through amino radicals or through hydroxy radicals are likewise useful as (a). Condensation through amino radicals results in a higher amine accompanied by removal of ammonia and condensation through the hydroxy radicals results in products containing ether linkages accompanied by removal of water.

The carboxylic derivative compositions (D) produced from the acylating reagents (D-1) and the amino compounds (D-2) described hereinbefore comprise acylated amines which include amine salts, amides, imides and imidazolines as well as mixtures thereof. To prepare carboxylic acid derivatives from the acylating reagents and the amino compounds, one or more acylating reagents and one or more amino compounds are heated at temperatures in the range of about 80° C. up to the decomposition point (where the decomposition point is as previously defined) but normally at temperatures in the range of about 100° C. up to about 300° C. provided 300° C. does not exceed the decomposition point. Temperatures of about 125° C. to about 250° C. are normally used. The acylating reagent and the amino compound are reacted in amounts sufficient to provide from about one-half equivalent up to less than one equivalent of amino compound per equivalent of acylating reagent. U.S. Pat. Nos. 3,172,892; 3,219,666; 3,272,746; and 4,234,435 are expressly incorporated herein by reference for their disclosures with respect to the procedures applicable to reacting the acylating reagents with the amino compounds as described above.

In order to produce carboxylic derivative compositions exhibiting viscosity index improving capabilities, it has been found generally necessary to react the acylating reagents with polyfunctional reactants. For example, polyamines having two or more primary and/or secondary amino groups are preferred. Obviously, however, it is not necessary that all of the amino compound reacted with the acylating reagents be polyfunctional. Thus, combinations of mono- and polyfunctional amino compounds can be used.

In one embodiment, the acylating agent is reacted with from about 0.70 equivalent to less than 1 equivalent (e.g., about 0.95 equivalent) of amine compound, per equivalent of acylating agent. The lower limit on the equivalents of amine compound may be 0.75 or even 0.80 up to about 0.90 or 0.95 equivalent, per equivalent of acylating agent. Thus narrower ranges of equivalents of acylating agents (D-1) to amino compounds (D-2) may be from about 0.70 to about 0.90 or about 0.75 to about 0.90 or about 0.75 to about 0.85. It appears, at least in some situations, that when the equivalent of amino compound is about 0.75 or less, per equivalent of acylating agent, the effectiveness of the carboxylic derivatives as dispersants is reduced. In one embodiment, the relative amounts of acylating agent and amine are such that the carboxylic derivative preferably contains no free carboxyl groups.

In another embodiment, the acylating agent is reacted with from about 1.0 to about 1.1 or up to about 1.5 or 2 equivalents of amino compound, per equivalent of acylating agent.

The amount of amine compound (D-2) within the above ranges that is reacted with the acylating agent (D-1) may also depend in part on the number and type of nitrogen atoms present. For example, a smaller amount of a polyamine containing one or more $—NH_2$ groups is required to react with a given acylating agent than a polyamine having the same number of nitrogen atoms and fewer or no $—NH_2$ groups. One $—NH_2$ group can react with two —COOH groups to form an imide. If only secondary nitrogens are present in the amine compound, each >NH group can react with only one —COOH group. Accordingly, the amount of polyamine within the above ranges to be reacted with the acylating agent to form the carboxylic derivatives of the invention can be readily determined from a consideration of the number and types of nitrogen atoms in the polyamine (i.e., $—NH_2$, >NH, and >N—).

The carboxylic derivative composition (D) may also be a carboxylic ester obtained by reacting the above-described acylating agent (D-1) with one or more alcohols or phenols of the formula $$R^3(OH)_m \qquad \text{(XII)}$$

wherein $R^3$ is a monovalent or polyvalent organic group joined to the —OH groups through a carbon bond, and m is an integer of from 1 to about 10. The carboxylic ester derivatives (D) are included in the oil compositions to provide dispersancy.

The alcohols (D-2) from which the esters may be derived preferably contain up to about 40 aliphatic carbon atoms. They may be monohydric alcohols such as methanol, ethanol, isooctanol, dodecanol, cyclohexanol, cyclopentanol, behenyl alcohol, hexatriacontanol, neopentyl alcohol, isobutyl alcohol, benzyl alcohol, beta-phenylethyl alcohol, 2-methylcyclohexanol, beta-chloroethanol, monomethyl ether of ethylene glycol, monobutyl ether of ethylene glycol, monopropyl ether of diethylene glycol, monododecyl ether of triethylene glycol, mono-oleate of ethylene glycol, monostearate of diethylene glycol, sec-pentyl alcohol, tert-butyl alcohol, 5-bromo-dodecanol, nitrooctadecanol and dioleate of glycerol. The polyhydric alcohols preferably contain from 2 to about 10 hydroxy groups. They are illustrated by, for example, ethylene glycol, diethylene glycol, triethylene glycol, tetraethylene glycol, dipropylene glycol, tripropylene glycol, dibutylene glycol, tributylene glycol, and other alkylene glycols in which the alkylene group contains from 2 to about 8 carbon atoms.

Other useful polyhydric alcohols include glycerol, monooleate of glycerol, monostearate of glycerol, monomethyl ether of glycerol, pentaerythritol, 9,10-dihydroxy stearic acid, 1,2-butanediol, 2,3-hexanediol, 2,4-hexanediol, pinacol, erythritol, arabitol, sorbitol, mannitol, 1,2-cyclohexanediol, and xylylene glycol.

An especially preferred class of polyhydric alcohols are those having at least three hydroxy groups, some of which have been esterified with a monocarboxylic acid having from about 8 to about 30 carbon atoms such as octanoic acid, oleic acid, stearic acid, linoleic acid, dodecanoic acid, or tall oil acid. Examples of such partially esterified polyhydric alcohols are the monooleate of sorbitol, distearate of sorbitol, monooleate of glycerol, monostearate of glycerol, di-dodecanoate of erythritol.

The esters (D) may also be derived from unsaturated alcohols such as allyl alcohol, cinnamyl alcohol, propargyl alcohol, 1-cyclohexen-3-ol, and oleyl alcohol. Still other classes of the alcohols capable of yielding the esters of this invention comprises the ether-alcohols and amino-alcohols including, for example, the oxy-alkylene-, oxy-arylene-, amino-alkylene-, and aminoarylene-substituted alcohols having one or more oxy-alkylene, amino-alkylene or amino-arylene oxy-arylene groups. They are exemplified by Cellosolve, Carbitol, phenoxyethanol, mono(heptylphenyl-oxypropylene)-substituted glycerol, poly(styrene oxide), aminoethanol, 3-amino ethylpentanol, di(hydroxyethyl) amine, p-aminophenol, tri(hydroxypropyl)amine, N-hydroxyethyl ethylene diamine, N,N,N',N'-tetrahydroxytrimethylene diamine, and the like. For the most part, the ether-alcohols having up to about 150 oxy-alkylene groups in which the alkylene group contains from 1 to about 8 carbon atoms are preferred.

The esters may be diesters of succinic acids or acidic esters, i.e., partially esterified succinic acids; as well as partially esterified polyhydric alcohols or phenols, i.e., esters having free alcoholic or phenolic hydroxyl groups. Mixtures of the esters illustrated above likewise are contemplated within the scope of this invention.

A suitable class of esters for use in the lubricating compositions of this invention are those diesters of succinic acid and an alcohol having up to about 9 aliphatic carbon atoms and having at least one substituent selected from the class consisting of amino and carboxy groups wherein the hydrocarbon substituent of the succinic acid is a polymerized butene substituent having a number average molecular weight of from about 700 to about 5000.

The esters (D) may be prepared by one of several known methods. The method which is preferred because of convenience and the superior properties of the esters it produces, involves the reaction of a suitable alcohol or phenol with a substantially hydrocarbon-substituted succinic anhydride. The esterification is usually carried out at a temperature above about 100° C., preferably between 150° C. and 300° C. The water formed as a by product is removed by distillation as the esterification proceeds.

In most cases the carboxylic ester derivatives are a mixture of esters, the precise chemical composition and the relative proportions of which in the product are difficult to determine. Consequently, the product of such reaction is best described in terms of the process by which it is formed.

A modification of the above process involves the replacement of the substituted succinic anhydride with the corresponding succinic acid. However, succinic acids readily undergo dehydration at temperatures above about 100° C. and are thus converted to their anhydrides which are then esterified by the reaction with the alcohol reactant. In this regard, succinic acids appear to be the substantial equivalent of their anhydrides in the process.

The relative proportions of the succinic reactant and the hydroxy reactant which are to be used depend to a large measure upon the type of the product desired and the number of hydroxyl groups present in the molecule of the hydroxy reactant. For instance, the formation of a half ester of a succinic acid, i.e., one in which only one of the two acid groups is esterified, involves the use of one mole of a monohydric alcohol for each mole of the substituted succinic acid reactant, whereas the formation of a diester of a succinic acid involves the use of two moles of the alcohol for each mole of the acid. On the other hand, one mole of a hexahydric alcohol may combine with as many as six moles of a succinic acid to form an ester in which each of the six hydroxyl groups of the alcohol is esterified with one of the two acid groups of the succinic acid. Thus, the maximum proportion of the succinic acid to be used with a polyhydric alcohol is determined by the number of hydroxyl groups present in the molecule of the hydroxy reactant. In one embodiment, esters obtained by the reaction of equimolar amounts of the succinic acid reactant and hydroxy reactant are preferred.

In some instances it is advantageous to carry out the esterification in the presence of a catalyst such as sulfuric acid, pyridine hydrochloride, hydrochloric acid, benzene sulfonic acid, p-toluene sulfonic acid, phosphoric acid, or any other known esterification catalyst. The amount of the catalyst in the reaction may be as little as 0.01% (by weight of the reaction mixture), more often from about 0.1% to about 5%.

The esters (D) may be obtained by the reaction of a substituted succinic acid or anhydride with an epoxide or a mixture of an epoxide and water. Such reaction is similar to one involving the acid or anhydride with a glycol. For instance, the ester may be prepared by the reaction of a substituted succinic acid with one mole of ethylene oxide. Similarly, the ester may be obtained by the reaction of a substituted succinic acid with two moles of ethylene oxide. Other epoxides which are commonly available for use in such reaction include, for example, propylene oxide, styrene oxide, 1,2-butylene oxide, 2,3-butylene oxide, epichlorohydrin, cyclohexene oxide, 1,2-octylene oxide, epoxidized soybean oil, methyl ester of 9,10-epoxy-stearic acid, and butadiene monoepoxide. For the most part, the epoxides are the alkylene oxides in which the alkylene group has from 2 to about 8 carbon atoms; or the epoxidized fatty acid esters in which the fatty acid group has up to about 30 carbon atoms and the ester group is derived from a lower alcohol having up to about 8 carbon atoms.

In lieu of the succinic acid or anhydride, a substituted succinic acid halide may be used in the processes illustrated above for preparing the esters. Such acid halides may be acid dibromides, acid dichlorides, acid monochlorides, and acid monobromides. The substituted succinic anhydrides and acids can be prepared by, for example, the reaction of maleic anhydride with a high molecular weight olefin or a halogenated hydrocarbon such as is obtained by the chlorination of an olefin polymer described previously. The reaction involves merely heating the reactants at a temperature preferably from about 100° C. to about 250° C. The product from such a reaction is an alkenyl succinic anhydride. The alkenyl group may be hydrogenated to an alkyl group. The anhydride may be hydrolyzed by treatment with water or steam to the corresponding acid. Another method useful for preparing the succinic acids or anhydrides involves the reaction of itaconic acid or anhydride with an olefin or a chlorinated hydrocarbon at a temperature usually within the range from about 100° C. to about 250° C. The succinic acid halides can be prepared by the reaction of the acids or their anhydrides with a halogenation agent such as phosphorus tribromide, phosphorus pentachloride, or thionyl chloride. Methods of preparing the carboxylic esters (D) are well known in the art and need not be illustrated in further detail here. For example, see U.S. Pat. No. 3,522,179 which is hereby incorporated by reference for its disclosure of the preparation of carboxylic ester compositions useful as component (D). The preparation of carboxylic ester derivative compositions from acylating agents wherein the substituent groups are derived from polyalkenes characterized by an Mn of at least about 1300 up to about 5000 and an $\overline{M}w/\overline{M}n$ ratio of from 1.5 to about 4 is described in U.S. Pat. No. 4,234,435 which is hereby incorporated by reference. The acylating agents described in the '435 patent are also characterized as having within their structure an average of at least 1.3 succinic groups for each equivalent weight of substituent groups.

The carboxylic ester derivatives which are described above resulting from the reaction of an acylating agent with a hydroxy containing compound such as an alcohol or a phenol may be further reacted with an amine, and particularly polyamines in the manner described previously for the reaction of the acylating agent (D-1) with amines (D-2) in preparing component (D). In one embodiment, the amount of amine which is reacted with the ester is an amount such that there is at least about 0.01 equivalent of the amine for each equivalent of acylating agent initially employed in the reaction with the alcohol. Where the acylating agent has been reacted with the alcohol in an amount such that there is at least one equivalent of alcohol for each equivalent of acylating agent, this small amount of amine is sufficient to react with minor amounts of non-esterified carboxyl groups which may be present. In one preferred embodiment, the amine-modified carboxylic acid esters utilized as component (D) are prepared by reacting about 1.0 to 2.0 equivalents, preferably about 1.0 to 1.8 equivalents of hydroxy compounds, and up to about 0.3 equivalent, preferably about 0.02 to about 0.25 equivalent of polyamine per equivalent of acylating agent.

In another embodiment, the carboxylic acid acylating agent may be reacted simultaneously with both the alcohol and the amine. There is generally at least about 0.01 equivalent of the alcohol and at least 0.01 equivalent of the amine although the total amount of equivalents of the combination should be at least about 0.5 equivalent per equivalent of acylating agent. These carboxylic ester derivative compositions which are useful as component (D) are known in the art, and the preparation of a number of these derivatives is described in, for example, U.S. Pat. Nos. 3,957,854 and 4,234,435 which have been incorporated by reference previously.

The preparation of the acylating agents and the carboxylic acid derivative compositions (D) is illustrated by the following examples. These examples illustrate presently preferred embodiments for obtaining the desired acylating agents and carboxylic acid derivative compositions sometimes referred to in the examples as "residue" or "filtrate" without specific determination or mention of other materials present or the amounts thereof.

Acylating Agents

EXAMPLE 1

A mixture of 510 parts (0.28 mole) of polyisobutene ($\overline{M}n$=1845; $\overline{M}w$=5325) and 59 parts (0.59 mole) of maleic anhydride is heated to 110° C. This mixture is heated to 190° C. in 7 hours during which 43 parts (0.6 mole) of gaseous chlorine is added beneath the surface. At 190°-192° C. an additional 11 parts (0.16 mole) of chlorine is added over 3.5 hours. The reaction mixture is stripped by heating at 190°-193° C. with nitrogen blowing for 10 hours. The residue is the desired polyisobutene-substituted succinic acylating agent having a saponification equivalent number of 87 as determined by ASTM procedure D-94.

EXAMPLE 2

A mixture of 1000 parts (0.495 mole) of polyisobutene ($\overline{M}n$=2020; $\overline{M}w$=6049) and 115 parts (1.17 moles) of maleic anhydride is heated to 110° C. This mixture is heated to 184° C. in 6 hours during which 85 parts (1.2 moles) of gaseous chlorine is added beneath the surface. At 184°-189° C. an additional 59 parts (0.83 mole) of chlorine is added over 4 hours. The reaction mixture is stripped by heating at 186°-190° C. with nitrogen blowing for 26 hours. The residue is the desired polyisobutene-substituted succinic acylating agent having a saponification equivalent number of 87 as determined by ASTM procedure D-94.

EXAMPLE 3

A mixture of 3251 parts of polyisobutene chloride, prepared by the addition of 251 parts of gaseous chlorine to 3000 parts of polyisobutene (Mn=1696; Mw=6594) at 80° C. in 4.66 hours, and 345 parts of maleic anhydride is heated to 200° C. in 0.5 hour. The reaction mixture is held at 200°-224° C. for 6.33 hours, stripped at 210° C. under vacuum and filtered. The filtrate is the desired polyisobutene-substituted succinic acylating agent having a saponification equivalent number of 94 as determined by ASTM procedure D-94.

Carboxylic Derivative Compositions (D)

EXAMPLE D-1

A mixture is prepared by the addition of 10.2 parts (0.25 equivalent) of a commercial mixture of ethylene polyamines having from about 3 to about 10 nitrogen atoms per molecule to 113 parts of mineral oil and 161 parts (0.25 equivalent) of the substituted succinic acylating agent prepared in Example 1 at 138° C. The reaction mixture is heated to 150° C. in 2 hours and stripped by blowing with nitrogen. The reaction mixture is filtered to yield the filtrate as an oil solution of the desired product.

EXAMPLE D-2

A mixture is prepared by the addition of 57 parts (1.38 equivalents) of a commercial mixture of ethylene polyamines having from about 3 to 10 nitrogen atoms per molecule to 1067 parts of mineral oil and 893 parts (1.38 equivalents) of the substituted succinic acylating agent prepared in Example 2 at 140°-145° C. The reaction mixture is heated to 155° C. in 3 hours and stripped by blowing with nitrogen. The reaction mixture is filtered to yield the filtrate as an oil solution of the desired product.

EXAMPLE D-3

A mixture of 1132 parts of mineral oil and 709 parts (1.2 equivalents) of a substituted succinic acylating agent prepared as in Example 1 is prepared, and a solution of 56.8 parts of piperazine (1.32 equivalents) in 200 parts of water is added slowly from a dropping funnel to the above mixture at 130°-140° C. over approximately 4 hours. Heating is continued to 160° C. as water is removed. The mixture is maintained at 160°-165° C. for one hour and cooled overnight. After reheating the mixture to 160° C., the mixture is maintained at this temperature for 4 hours. Mineral oil (270 parts) is added, and the mixture is filtered at 150° C. through a filter aid. The filtrate is an oil solution of the desired product (65% oil) containing 0.65% nitrogen (theory, 0.86%).

EXAMPLE D-4

A mixture of 1968 parts of mineral oil and 1508 parts (2.5 equivalents) a substituted succinic acylating agent prepared as in Example 1 is heated to 145° C. whereupon 125.6 parts (3.0 equivalents) of a commercial mixture of ethylene polyamines as used in Example D-1 are added over a period of 2 hours while maintaining the reaction temperature at 145°-150° C. The reaction mixture is stirred for 5.5 hours at 150°-152° C. while blowing with nitrogen. The mixture is filtered at 150° C. with a filter aid. The filtrate is an oil solution of the desired product (55% oil) containing 1.20% nitrogen (theory, 1.17).

EXAMPLE D-5

A mixture of 4082 parts of mineral oil and 250.8 parts (6.24 equivalents) of a commercial mixture of ethylene polyamine of the type utilized in Example D-1 is heated to 110° C. whereupon 3136 parts (5.2 equivalents) of a substituted succinic acylating agent prepared as in Example 1 are added over a period of 2 hours. During the addition, the temperature is maintained at 110°-120° C. while blowing with nitrogen. When all of the amine has been added, the mixture is heated to 160° C. and maintained at this temperature for about 6.5 hours while removing water. The mixture is filtered at 140° C. with a filter aid, and the filtrate is an oil solution of the desired product (55% oil) containing 1.17% nitrogen (theory, 1.18).

EXAMPLE D-6

A mixture of 3660 parts (6 equivalents) of a substituted succinic acylating agent prepared as in Example 1 in 4664 parts of diluent oil is prepared and heated at about 110° C. whereupon nitrogen is blown through the mixture. To this mixture there are then added 210 parts (5.25 equivalents) of a commercial mixture of ethylene polyamines containing from about 3 to about 10 nitrogen atoms per molecule over a period of one hour and the mixture is maintained at 110° C. for an additional 0.5 hour. After heating for 6 hours at 155° C. while removing water, a filtrate is added and the reaction mixture is filtered at about 150° C. The filtrate is the oil solution of the desired product.

EXAMPLE D-7

The general procedure of Example D-6 is repeated with the exception that 0.8 equivalent of a substituted succinic acylating agent as prepared in Example 1 is reacted with 0.67 equivalent of the commercial mixture of ethylene polyamines. The product obtained in this manner is an oil solution of the product containing 55% diluent oil.

EXAMPLE D-8

A substantially hydrocarbon-substituted succinic anhydride is prepared by chlorinating a polyisobutene having a molecular weight of 1000 to a chlorine content of 4.5% and then heating the chlorinated polyisobutene with 1.2 molar proportions of maleic anhydride at a temperature of 150°-220° C. The succinic anhydride thus obtained has an acid number of 130. A mixture of 874 grams (1 mole) of the succinic anhydride and 104 grams (1 mole) of neopentyl glycol is maintained at 240°-250° C./30 mm for 12 hours. The residue is a mixture of the esters resulting from the esterification of one and both hydroxy groups of the glycol. It has a saponification number of 101 and an alcoholic hydroxyl content of 0.2%.

EXAMPLE D-9

The dimethyl ester of the substantially hydrocarbon-substituted succinic anhydride of Example D-8 is prepared by heating a mixture of 2185 grams of the anhydride, 480 grams of methanol, and 1000 cc of toluene at 50°-65° C. while hydrogen chloride is bubbled through the reaction mixture for 3 hours. The mixture is then heated at 60°-65° C. for 2 hours, dissolved in benzene, washed with water, dried and filtered. The filtrate is heated at 150° C./60 mm to remove volatile components. The residue is the desired dimethyl ester.

EXAMPLE D-10

A mixture of 334 parts (0.52 equivalent) of the polyisobutene-substituted succinic acylating agent prepared in Example D-9, 548 parts of mineral oil, 30 parts (0.88 equivalent) of pentaerythritol and 8.6 parts (0.0057 equivalent) of Polyglycol 112-2 demulsifier from Dow Chemical Company is heated at 150° C. for 2.5 hours. The reaction mixture is heated to 210° C. in 5 hours and held at 210° C. for 3.2 hours. The reaction mixture is cooled to 190° C. and 8.5 parts (0.2 equivalent) of a commercial mixture of ethylene polyamines having an average of about 3 to about 10 nitrogen atoms per molecule are added. The reaction mixture is stripped by heating at 205° C. with nitrogen blowing for 3 hours, then filtered to yield the filtrate as an oil solution of the desired product.

EXAMPLE D-11

A mixture of 322 parts (0.5 equivalent) of the polyisobutene-substituted succinic acylating agent prepared in Example D-9, 68 parts (2.0 equivalents) of pentaerythritol and 508 parts of mineral oil is heated at 204°-227° C. for 5 hours. The reaction mixture is cooled to 162° C. and 5.3 parts (0.13 equivalent) of a commercial ethylene polyamine mixture having an average of about 3 to 10 nitrogen atoms per molecule is added. The reaction mixture is heated at 162°-163° C. for one hour, then cooled to 130° C. and filtered. The filtrate is an oil solution of the desired product.

EXAMPLE D-12

(a) A mixture of 1000 parts of polyisobutene having a number average molecular weight of about 1000 and 108 parts (1.1 moles) of maleic anhydride is heated to about 190° C. and 100 parts (1.43 moles) of chlorine are added beneath the surface over a period of about 4 hours while maintaining the temperature at about 185°-190° C. The mixture then is blown with nitrogen at this temperature for several hours, and the residue is the desired polyisobutene-substituted succinic acylating agent.

(b) A solution of 1000 parts of the acylating agent preparation (a) in 857 parts of mineral oil is heated to about 150° C. with stirring, and 109 parts (3.2 equivalents) of pentaerythritol are added with stirring. The mixture is blown with nitrogen and heated to about 200° C. over a period of about 14 hours to form an oil solution of the desired carboxylic ester intermediate. To the intermediate, there are added 19.25 parts (0.46 equivalent) of a commercial mixture of ethylene polyamines having an average of about 3 to about 10 nitrogen atoms per molecule. The reaction mixture is stripped by heating at 205° C. with nitrogen blowing for 3 hours and filtered. The filtrate is an oil solution (45% oil) of the desired amine-modified carboxylic ester which contains 0.35% nitrogen.

EXAMPLE D-13

(a) A mixture of 1000 parts (0.495 mole) of polyisobutene having a number average molecular weight of 2020 and a weight average molecular weight of 6049 and 115 parts (1.17 moles) of maleic anhydride is heated to 184° C. over 6 hours, during which time 85 parts (1.2 moles) of chlorine are added beneath the surface. An additional 59 parts (0.83 mole) of chlorine are added over 4 hours at 184°-189° C. The mixture is blown with nitrogen at 186°-190° C. for 26 hours. The residue is a polyisobutene-substituted succinic anhydride having a total acid number of 95.3.

(b) A solution of 409 parts (0.66 equivalent) of the substituted succinic anhydride in 191 parts of mineral oil is heated to 150° C. and 42.5 parts (1.19 equivalent) of pentaerythritol are added over 10 minutes, with stirring, at 145°-150° C. The mixture is blown with nitrogen and heated to 205°-210° C. over about 14 hours to yield an oil solution of the desired polyester intermediate.

Diethylene triamine, 4.74 parts (0.138 equivalent), is added over one-half hour at 160° C. with stirring, to 988 parts of the polyester intermediate (containing 0.69 equivalent of substituted succinic acylating agent and 1.24 equivalents of pentaerythritol). Stirring is continued at 160° C. for one hour, after which 289 parts of mineral oil are added. The mixture is heated for 16 hours at 135° C. and filtered at the same temperature, using a filter aid material. The filtrate is a 35% solution in mineral oil of the desired amine-modified polyester. It has a nitrogen content of 0.16% and a residual acid number of 2.0.

EXAMPLE D-14

The general procedure of Example D-13 is repeated with 1000 parts of the acylating agent of Example 3, 96.8 parts of monopentaerythritol, 27.5 parts of diethylenetriamine, and a total of 2056 parts of diluent oil. The filtrate obtained is a 65% mineral oil solution containing 0.30% nitrogen.

(E) Metal Dihydrocarbyl Dithiophosphate.

In another embodiment, the oil compositions of the present invention also contain (E) at least one metal dihydrocarbyl dithiophosphate characterized by the formula

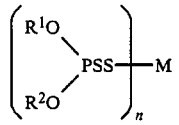

(XIII)

wherein $R^1$ and $R^2$ are each independently hydrocarbyl groups containing from 3 to about 13 carbon atoms, M is a metal, and n is an integer equal to the valence of M.

Generally, the oil compositions of the present invention will contain varying amounts of one or more of the above-identified metal dithiophosphates such as from about 0.01% to about 2% by weight, and more generally from about 0.01% to about 1% by weight based on the weight of the total oil composition. The metal dithiophosphates are added to the lubricating oil compositions of the invention to improve the anti-wear and antioxidant properties of the oil compositions.

The hydrocarbyl groups $R^1$ and $R^2$ in the dithiophosphate of Formula XIII may be alkyl, cycloalkyl, aralkyl or alkaryl groups, or a substantially hydrocarbon group of similar structure. By "substantially hydrocarbon" is meant hydrocarbons which contain substituent groups such as ether, ester, nitro, or halogen which do not materially affect the hydrocarbon character of the group.

Illustrative alkyl groups include n-propyl, isopropyl, isobutyl, n-butyl, sec-butyl, the various amyl groups, n-hexyl, methylisobutyl carbinyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals Many substituted hydrocarbon groups may also be used, e.g., chloropentyl, dichlorophenyl, and dichlorodecyl.

The phosphorodithioic acids from which the metal salts useful in this invention are prepared are well known. Examples of dihydrocarbyl phosphorodithioic acids and metal salts, and processes for preparing such acids and salts are found in, for example, U.S. Pat. Nos. 4,263,150; 4,289,635; 4,308,154; 4,417,990; and 4,466,895. These patents are hereby incorporated by reference for such disclosures.

The phosphorodithioic acids are prepared by the reaction of phosphorus pentasulfide with an alcohol or phenol or mixtures of alcohols. The reaction involves four moles of the alcohol or phenol per mole of phosphorus pentasulfide, and may be carried out within the temperature range from about 50° C. to about 200° C.

The metal salts of dihydrocarbyl dithiophosphates which are useful in this invention include those salts containing Group I metals, Group II metals, aluminum, lead, tin, molybdenum, manganese, cobalt, and nickel. The Group II metals, aluminum, tin, iron, cobalt, lead, molybdenum, manganese, nickel and copper are among the preferred metals. Zinc and copper are especially useful metals. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin butylate, cobalt hydroxide, nickel hydroxide, nickel carbonate, etc.

In one preferred embodiment, the alkyl groups $R^1$ and $R^2$ are derived from secondary alcohols such as isopropyl alcohol, secondary butyl alcohol, 2-pentanol, 2-methyl-4-pentanol, 2-hexanol, 3-hexanol, etc.

Especially useful metal phosphorodithioates can be prepared from phosphorodithioic acids which in turn are prepared by the reaction of phosphorus pentasulfide with mixtures of alcohols. In addition, the use of such mixtures enables the utilization of cheaper alcohols which in themselves may not yield oil-soluble phosphorodithioic acids. Thus a mixture of isopropyl and hexyl alcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: isopropanol and isobutanol; n-butanol and n-octanol; n-pentanol and 2-ethyl-1-hexanol; isobutanol and n-hexanol; isobutanol and isoamyl alcohol; isopropanol and 2-methyl-4-pentanol; isopropanol and sec-butyl alcohol; isopropanol and isooctyl alcohol; etc.

In one preferred embodiment, at least one of the phosphorodithioic acid salts included in the mixture (E) is characterized as containing one hydrocarbyl group (E-1) which is an isopropyl or secondary butyl group, and the other hydrocarbyl group (E-2) contains at least four carbon atoms. These acids are prepared from mixtures of the corresponding alcohols The alcohol mixtures which are utilized in the preparation of these phosphorodithioic acids comprise mixtures of isopropyl alcohol, secondary butyl alcohol or a mixture of isopropyl and secondary butyl alcohols, and at least one primary or secondary aliphatic alcohol containing from about 4 to 13 carbon atoms. In particular, the alcohol mixture will contain at least 20, 25 or 30 mole percent of isopropyl and/or secondary butyl alcohol and will generally comprise from about 20 mole percent to about 90 mole percent of isopropyl or secondary butyl alcohol. In one preferred embodiment, the alcohol mixture will comprise from about 30 to about 60 mole percent of isopropyl alcohol, the remainder being one or more secondary aliphatic alcohols.

The primary alcohols which may be included in the alcohol mixture include n-butyl alcohol, n-amyl alcohol, isoamyl alcohol, n-hexyl alcohol, 2-ethyl-1-hexyl alcohol, isooctyl alcohol, nonyl alcohol, decyl alcohol, dodecyl alcohol, tridecyl alcohol, etc. The primary alcohols also may contain various substituent groups such as halogens. Particular examples of useful mixtures of alcohols include, for example, isopropyl/2-ethyl-1-hexyl; isopropyl/isooctyl; isopropyl/decyl; isopropyl/-dodecyl; and isopropyl/tridecyl. In one prefered embodiment, the primary alcohols will contain from 4 to 13 carbon atoms, and the total number of carbon atoms per phosphorus atom in the required phosphorodithioic acid salt will be at least 8.

The composition of the phosphorodithioic acid obtained by the reaction of a mixture of alcohols (e.g., iPrOH and $R^2OH$) with phosphorus pentasulfide is actually a statistical mixture of three or more phosphorodithioic acids as illustrated by the following formulae:

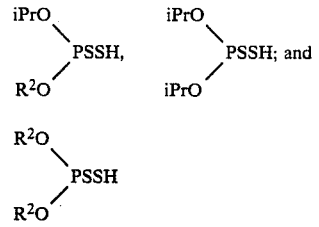

In the present invention it is preferred to select the amount of the two or more alcohols reacted with $P_2S_5$ to result in a mixture in which the predominating dithiophosphoric acid is the acid (or acids) containing one isopropyl group or one secondary isobutyl group, and one primary or secondary alkyl group containing at least 5 carbon atoms. The relative amounts of the three phosphorodithioic acids in the statistical mixture is dependent, in part, on the relative amounts of the alcohols in the mixture, steric effects, etc.

The following examples illustrate the preparation of metal phosphorodithioates prepared from mixtures of alcohols containing isopropyl alcohol as one of the alcohols.

EXAMPLE E-1

A phosphorodithioic acid mixture is prepared by reacting a mixture of alcohols comprising 6 moles of 4-methyl-2-pentanol and 4 moles of isopropyl alcohol with phosphorus pentasulfide. The phosphorodithioic acid then is reacted with an oil slurry of zinc oxide. The amount of zinc oxide in the slurry is about 1.08 times the theoretical amount required to completely neutralize the phosphorodithioic acid. The oil solution of the zinc phosphorodithioate mixture obtained in this manner (10% oil) contains 9.5% phosphorus, 20.0% sulfur and 10.5% zinc.

EXAMPLE E-2

A phosphorodithioic acid mixture is prepared by reacting finely powdered phosphorus pentasulfide with an alcohol mixture containing 11.53 moles (692 parts by weight) of isopropyl alcohol and 7.69 moles (1000 parts by weight) of isooctanol. The phosphorodithioic acid mixture obtained in this manner has an acid number of about 178–186 and contains 10.0% phosphorus and 21.0% sulfur. This phosphorodithioic acid mixture is then reacted with an oil slurry of zinc oxide. The quantity of zinc oxide included in the oil slurry is 1.10 times the theoretical equivalent of the acid number of the phosphorodithioic acid. The oil solution of the zinc salt prepared in this manner contains 12% oil, 8.6% phosphorus, 18.5% sulfur and 9.5% zinc.

EXAMPLE E-3

A phosphorodithioic acid is prepared by reacting a mixture of 1560 parts (12 moles) of isooctyl alcohol and 180 parts (3 moles) of isopropyl alcohol with 756 parts (3.4 moles) of phosphorus pentasulfide. The reaction is conducted by heating the alcohol mixture to about 55° C. and thereafter adding the phosphorus pentasulfide over a period of 1.5 hours while maintaining the reaction temperature at about 60°–75° C. After all of the phosphorus pentasulfide is added, the mixture is heated and stirred for an additional hour at 70°-75° C., and thereafter filtered through a filter aid.

Zinc oxide (282 parts, 6.87 moles) is charged to a reactor with 278 parts of mineral oil. The above-prepared phosphorodithioic acid mixture (2305 parts, 6.28 moles) is charged to the zinc oxide slurry over a period of 30 minutes with an exotherm to 60° C. The mixture then is heated to 80° C. and maintained at this temperature for 3 hours. After stripping to 100° C. and 6 mm.Hg, the mixture is filtered twice through a filter aid, and the filtrate is the desired oil solution of the zinc salt containing 10% oil, 7.97% zinc (theory 7.40); 7.21% phosphorus (theory 7.06); and 15.64% sulfur (theory 14.57).

(F) Sulfurized Olefins.

The oil compositions of the present invention also may contain (F) one or more sulfur-containing composition useful in improving the anti-wear, extreme pressure and antioxidant properties of the lubricating oil compositions. The oil compositions may include from about 0.01 to about 2% by weight of the sulfurized olefins. Sulfur-containing compositions prepared by the sulfurization of various organic materials including olefins are useful. The olefins may be any aliphatic, arylaliphatic or alicyclic olefinic hydrocarbon containing from about 3 to about 30 carbon atoms.

The olefinic hydrocarbons contain at least one olefinic double bond, which is defined as a non-aromatic double bond; that is, one connecting two aliphatic carbon atoms. In its broadest sense, the olefinic hydrocarbon may be defined by the formula $$R^7R^8C{=}CR^9R^{10}$$

wherein each of $R^7$, $R^8$, $R^9$ and $R^{10}$ is hydrogen or a hydrocarbon (especially alkyl or alkenyl) radical. Any two of $R^7$, $R^8$, $R^9$, $R^{10}$ may also together form an alkylene or substituted alkylene group; i.e., the olefinic compound may be alicyclic.

Monoolefinic and diolefinic compounds, particularly the former, are preferred, and especially terminal monoolefinic hydrocarbons; that is, those compounds in which $R^9$ and $R^{10}$ are hydrogen and $R^7$ and $R^8$ are alkyl (that is, the olefin is aliphatic). Olefinic compounds having about 3-20 carbon atoms are particularly desirable.

Propylene, isobutene and their dimers, trimers and tetramers, and mixtures thereof are especially preferred olefinic compounds. Of these compounds, isobutene and diisobutene are particularly desirable because of their availability and the particularly high sulfur-containing compositions which can be prepared therefrom.

The sulfurizing reagent may be, for example, sulfur, a sulfur halide such as sulfur monochloride or sulfur dichloride, a mixture of hydrogen sulfide and sulfur or sulfur dioxide, or the like. Sulfur-hydrogen sulfide mixtures are often preferred and are frequently referred to hereinafter; however, it will be understood that other sulfurization agents may, when appropriate, be substituted therefor.

The amounts of sulfur and hydrogen sulfide per mole of olefinic compound are, respectively, usually about 0.3-3.0 gram-atoms and about 0.1-1.5 moles. The preferred ranges are about 0.5-2.0 gram-atoms and about 0.5-1.25 moles respectively, and the most desirable ranges are about 1.2-1.8 gram-atoms and about 0.4-0.8 mole respectively.

The temperature range in which the sulfurization reaction is carried out is generally about 50°-350° C. The preferred range is about 100°-200° C., with about 125°-180° C. being especially suitable. The reaction is often preferably conducted under superatmospheric pressure; this may be and usually is autogenous pressure (i.e., the pressure which naturally develops during the course of the reaction) but may also be externally applied pressure. The exact pressure developed during the reaction is dependent upon such factors as the design and operation of the system, the reaction temperature and the vapor pressure of the reactants and products and it may vary during the course of the reaction.

It is frequently advantageous to incorporate materials useful as sulfurization catalysts in the reaction mixture. These materials may be acidic, basic or neutral, but are preferably basic materials, especially nitrogen bases including ammonia and amines, most often alkylamines. The amount of catalyst used is generally about 0.01-2.0% of the weight of the olefinic compound. In the case of the preferred ammonia and amine catalysts, about 0.0005-0.5 mole per mole of olefin is preferred, and about 0.001-0.1 mole is especially desirable.

Following the preparation of the sulfurized mixture, it is preferred to remove substantially all low boiling materials, typically by venting the reaction vessel or by distillation at atmospheric pressure, vacuum distillation or stripping, or passage of an inert gas such as nitrogen through the mixture at a suitable temperature and pressure.

A further optional step in the preparation of component (F) is the treatment of the sulfurized product, obtained as described hereinabove, to reduce active sulfur. An illustrative method is treatment with an alkali metal sulfide. Other optional treatments may be employed to remove insoluble by-products and improve such qualities as the odor, color and staining characteristics of the sulfurized compositions.

U.S. Pat. No. 4,119,549 is incorporated by reference herein for its disclosure of suitable sulfurized olefins useful in the lubricating oils of the present invention. Several specific sulfurized compositions are described in the working examples thereof. The following examples illustrate the preparation of such a composition.

EXAMPLE F-1

Sulfur (629 parts, 19.6 moles) is charged to a jacketed high-pressure reactor which is fitted with agitator and internal cooling coils. Refrigerated brine is circulated through the coils to cool the reactor prior to the introduction of the gaseous reactants. After sealing the reactor, evacuating to about 6 torr and cooling, 1100 parts (9.6 moles) of isobutene, 334 parts (9.8 moles) of hydrogen sulfide and 7 parts of n-butylamine are charged to the reactor. The reactor is heated, using steam in the external jacket, to a temperature of about 171° C. over about 1.5 hours. A maximum pressure of 720 psig is reached at about 138° C. during this heat-up. Prior to reaching the peak reaction temperature, the pressure starts to decrease and continues to decrease steadily as the gaseous reactants are consumed. After about 4.75 hours at about 171° C., the unreacted hydrogen sulfide and isobutene are vented to a recovery system. After the pressure in the reactor has decreased to atmospheric, the sulfurized product is recovered as a liquid.

Sulfur-containing compositions characterized by the presence of at least one cycloaliphatic group with at least two nuclear carbon atoms of one cycloaliphatic group or two nuclear carbon atoms of different cycloaliphatic groups joined together through a divalent sulfur linkage also are useful in component (F) in the lubricating oil compositions of the present invention. These types of sulfur compounds are described in, for example, U.S. Reissue Pat. No. Re 27,331, the disclosure which is hereby incorporated by reference. The sulfur linkage contains at least two sulfur atoms, and sulfurized Diels-Alder adducts are illustrative of such compositions.

In general, the sulfurized Diels-Alder adducts are prepared by reacting sulfur with at least one Diels-Alder adduct at a temperature within the range of from about 110° C. to just below the decomposition temperature of the adduct. The molar ratio of sulfur to adduct is generally from about 0.5:1 to about 10:1. The Diels-Alder adducts are prepared by known techniques by reacting a conjugated diene with an ethylenically or acetylenically unsaturated compound (dienophile). Examples of conjugated dienes include isoprene, methylisoprene, chloroprene, and 1,3-butadiene. Examples of suitable ethylenically unsaturated compounds include alkyl acrylates such as butyl acrylate and butyl methacrylate. In view of the extensive discussion in the prior art of the preparation of various sulfurized Diels-Alder adducts, it is believed unnecessary to lengthen this application by incorporating any further discussion of the preparation of such sulfurized products. The following examples illustrate the preparation of two such compositions.

EXAMPLE F-2

(a) A mixture comprising 400 grams of toluene and 66.7 grams of aluminum chloride is charged to a two-liter flask fitted with a stirrer, nitrogen inlet tube, and a solid carbon dioxide-cooled reflux condenser. A second mixture comprising 640 grams (5 moles) of butylacrylate and 240.8 grams of toluene is added to the $AlCl_3$ slurry over a 0.25-hour period while maintaining the temperature within the range of 37°-58° C. Thereafter, 313 grams (5.8 moles) of butadiene are added to the slurry over a 2.75-hour period while maintaining the temperature of the reaction mass at 60°-61° C. by means of external cooling. The reaction mass is blown with nitrogen for about 0.33-hour and then transferred to a four-liter separatory funnel and washed with a solution of 150 grams of concentrated hydrochloric acid in 1100 grams of water. Thereafter, the product is subjected to two additional water washings using 1000 ml of water for each wash. The washed reaction product is subsequently distilled to remove unreacted butylacrylate and toluene. The residue of this first distillation step is subjected to further distillation at a pressure of 9-10 millimeters of mercury whereupon 785 grams of the desired adduct are collected over the temperature of 105°-115° C.

(b) The above-prepared adduct of butadiene-butylacrylate (4550 grams, 25 moles) and 1600 grams (50 moles) of sulfur flowers are charged to a 12 liter flask, fitted with stirrer, reflux condenser, and nitrogen inlet tube. The reaction mixture is heated at a temperature within the range of 150°-155° C. for 7 hours while passing nitrogen therethrough at a rate of about 0.5 cubic feet per hour. After heating, the mass is permitted to cool to room temperature and filtered, the sulfur-containing product being the filtrate.

EXAMPLE F-3

(a) An adduct of isoprene and acrylonitrile is prepared by mixing 136 grams of isoprene, 172 grams of methylacrylate, and 0.9 gram of hydroquinone (polymerization inhibitor) in a rocking autoclave and thereafter heating for 16 hours at a temperature within the range of 130°-140° C. The autoclave is vented and the contents decanted thereby producing 240 grams of a light yellow liquid. This liquid is stripped at a temperature of 90° C. and a pressure of 10 millimeters of mercury thereby yielding the desired liquid product as the residue.

(b) To 255 grams (1.65 moles) of the isoprenemethacrylate adduct of (a) heated to a temperature of 110°-120° C., there are added 53 grams (1.65 moles) of sulfur flowers over a 45-minute period. The heating is continued for 4.5 hours at a temperature in the range of 130°-160° C. After cooling to room temperature, the reaction mixture is filtered through a medium sintered glass funnel. The filtrate consists of 301 grams of the desired sulfur-containing products.

(c) In part (b) the ratio of sulfur to adduct is 1:1. In this example, the ratio is 5:1. Thus, 640 grams (20 moles) of sulfur flowers are heated in a three-liter flask at 170° C. for about 0.3 hour. Thereafter, 600 grams (4 moles) of the isoprene-methacrylate adduct of (a) are added dropwise to the molten sulfur while maintaining the temperature at 174°-198° C. Upon cooling to room temperature, the reaction mass is filtered as above, the filtrate being the desired product.

Other extreme pressure agents and corrosion- and oxidation-inhibiting agents also may be included and are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentyl phenyl phosphite, dipentyl phenyl phosphite, tridecyl phosphite, distearyl phosphite, dimethyl naphthyl phosphite, oleyl 4-phenylphenol phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith Lezius-Hiles Co. publishers, Cleveland, Ohio, 1967.

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498;

2,666,746; 2,721,877; 2,721,878; and 3,250,715 which are hereby incorporated by reference for their relevant disclosures.

Anti-foam agents are used to reduce or prevent the formation of stable foam. Typical anti-foam agents include silicones or organic polymers. Additional anti-foam compositions are described in "Foam Control Agents" by Henry T. Kerner (Noyes Data Corporation, 1976), pages 125–162.

The lubricating oil compositions of the present invention also may contain, particularly when the lubricating oil compositions are formulated into multigrade oils, one or more commercially available viscosity modifiers. Viscosity modifiers generally are polymeric materials characterized as being hydrocarbon-based polymers generally having number average molecular weights between about 25,000 and 500,000 more often between about 50,000 and 200,000.

Polyisobutylene has been used as a viscosity modifier in lubricating oils. Polymethacrylates (PMA) are prepared from mixtures of methacrylate monomers having different alkyl groups. Most PMA's are viscosity-modifiers as well as pour point depressants. The alkyl groups may be either straight chain or branched chain groups containing from 1 to about 18 carbon atoms.

When a small amount of a nitrogen-containing monomer is copolymerized with alkyl methacrylates, dispersancy properties also are incorporated into the product. Thus, such a product has the multiple function of viscosity modification, pour point depressants and dispersancy. Such products have been referred to in the art as dispersant-type viscosity modifiers or simply dispersant-viscosity modifiers. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity-modifiers.

Ethylene-propylene copolymers, generally referred to as OCP can be prepared by copolymerizing ethylene and propylene, generally in a solvent, using known catalysts such as a Ziegler-Natta initiator. The ratio of ethylene to propylene in the polymer influences the oil-solubility, oil-thickening ability, low temperature viscosity, pour point depressant capability and engine performance of the product. The common range of ethylene content is 45–60% by weight and typically is from 50% to about 55% by weight. Some commercial OCP's are terpolymers of ethylene, propylene and a small amount of nonconjugated diene such as 1,4-hexadiene. In the rubber industry, such terpolymers are referred to as EPDM (ethylene propylene diene monomer). The use of OCP's as viscosity modifiers in lubricating oils has increased rapidly since about 1970, and the OCP's are currently one of the most widely used viscosity modifiers for motor oils.

Esters obtained by copolymerizing styrene and maleic anhydride in the presence of a free radical initiator and thereafter esterifying the copolymer with a mixture of $C_{4-18}$ alcohols also are useful as viscosity modifying additives in motor oils. The styrene esters generally are considered to be multifunctional premium viscosity modifiers. The styrene esters in addition to their viscosity modifying properties also are pour point depressants and exhibit dispersancy properties when the esterification is terminated before its completion leaving some unreacted anhydride or carboxylic acid groups. These acid groups can then be converted to imides by reaction with a primary amine.

Hydrogenated styrene-conjugated diene copolymers are another class of commercially available viscosity modifiers for motor oils. Examples of styrenes include styrene, alpha-methyl styrene, ortho-methyl styrene, meta-methyl styrene, para-methyl styrene, para-tertiary butyl styrene, etc. Preferably the conjugated diene contains from four to six carbon atoms. Examples of conjugated dienes include piperylene, 2,3-dimethyl-1,3-butadiene, chloroprene, isoprene and 1,3-butadiene, with isoprene and butadiene being particularly preferred. Mixtures of such conjugated dienes are useful.

The styrene content of these copolymers is in the range of about 20% to about 70% by weight, preferably about 40% to about 60% by weight. The aliphatic conjugated diene content of these copolymers is in the range of about 30% to about 80% by weight, preferably about 40% to about 60% by weight.

These copolymers typically have number average molecular weights in the range of about 30,000 to about 500,000, preferably about 50,000 to about 200,000. The weight average molecular weight for these copolymers is generally in the range of about 50,000 to about 500,000, preferably about 50,000 to about 300,000.

The above described hydrogenated copolymers have been described in the prior art such as in U.S. Pat. Nos. 3,551,336; 3,598,738; 3,554,911; 3,607,749; 3,687,849; and 4,181,618 which are hereby incorporated by reference for their disclosures of polymers and copolymers useful as viscosity modifiers in the oil compositions of this invention. For example, U.S. Pat. No. 3,554,911 describes a hydrogenated random butadiene-styrene copolymer, its preparation and hydrogenation. The disclosure of this patent is incorporated herein by reference. Hydrogenated styrene-butadiene copolymers useful as viscosity modifiers in the lubricating oil compositions of the present invention are available commercially from, for example, BASF under the general trade designation "Glissoviscal". A particular example is a hydrogenated styrene-butadiene copolymer available under the designation Glissoviscal 5260 which has a molecular weight, determined by gel permeation chromatography, of about 120,000. Hydrogenated styrene-isoprene copolymers useful as viscosity modifiers are available from, for example, The Shell Chemical Company under the general trade designation "Shellvis". Shellvis 40 from Shell Chemical Company is identified as a diblock copolymer of styrene and isoprene having a number average molecular weight of about 155,000, a styrene content of about 19 mole percent and an isoprene content of about 81 mole percent. Shellvis 50 is available from Shell Chemical Company and is identified as a diblock copolymer of styrene and isoprene having a number average molecular weight of about 100,000, a styrene content of about 28 mole percent and an isoprene content of about 72 mole percent.

The amount of polymeric viscosity modifier incorporated in the lubricating oil compositions of the present invention may be varied over a wide range although lesser amounts than normal are employed when certain of the carboxylic acid derivative component (D) are included in the oil which function as viscosity modifiers in addition to functioning as dispersants. In general, the amount of polymeric viscosity improver included in the lubricating oil compositions of the invention may be as high as 10% by weight based on the weight of the finished lubricating oil. More often, the polymeric viscosity improvers are used in concentrations of about 0.2% to about 8% and more particularly, in amounts from about 0.5% to about 6% by weight of the finished lubricating oil.

The lubricating oils of the present invention may be prepared by dissolving or suspending the various components directly in a base oil along with any other additives which may be used. More often, the chemical components of the present invention are diluted with a substantially inert, normally liquid organic diluent such as mineral oil, naphtha, benzene, etc. to form an additive concentrate. These concentrates usually comprise from about 0.01% to about 80% by weight of one or more of the additive components (B) through (F) described above.

In one embodiment, the lubricating oil compositions of the present invention are useful for both gasoline-fueled and alcohol-fueled spark-ignited engines, and such compositions will comprise (A) an oil of lubricating viscosity; (B) at least one detergent as defined above; and (C) at least one metal salt as defined above. These compositions also may contain one or more carboxylic derivative compositions (D) as defined above, mixtures of metal salts of dihydrocarbylphosphorodithioic acids (E) as defined above and/or sulfurized olefins (F) as defined above. Any of the other additives described in the specification such as viscosity index improvers, anti-wear agents, etc., may be also included in the lubricating oil compositions of the invention which are useful for both gasoline-fueled and alcohol-fueled spark-ignited engines. The use of such lubricating oil compositions in such fueled spark-ignited engines improves the performance of such engines by preventing or reducing deposits in the combustion chambers, preignition of the fuel, and corrosion of various metal parts of the engine. Lubricating oil compositions for gasoline-fueled and/or alcohol-fueled spark-ignited engines also can be formulated in accordance with the present invention with the additives described herein which meets all the performance requirements of the API Service Classification identified as "SG".

The present invention also relates to the method of operating gasoline- and/or alcohol-fueled, spark-ignited engines which comprises lubricating said engines during operation with the oil compositions of the present invention. The operation of such engines with the oil compositions of the present invention results in the prevention or reduction of corrosion and deposits in the combustion chamber and the elimination or reduction of pre-ignition of the alcohol-fueled, spark-ignited engines.

Lubricating compositions which are useful primarily for lubricating alcohol-fueled, spark-ignited engines may comprise, in accordance with the present invention, Oil compositions comprising (A) an oil of lubricating viscosity as described previously; (B) at least one detergent selected from the group consisting of a basic magnesium salt of an organic acid, or a mixture of at least one basic magnesium salt of an organic acid and another alkaline earth metal salt of an organic acid wherein the metal in the mixture is predominantly magnesium; and (D) at least one carboxylic derivative composition produced by reacting (D-1) at least one substituted succinic acylating agent with (D-2) a reactant selected from the group consisting of at least one amine compound characterized by the presence within its structure of at least one HN< group; at least one alcohol; or mixtures of said amines and alcohols. In another embodiment, such oils also contain (E) a mixture of metal salts of dihydrocarbyl phosphorodithioic acids wherein in at least one of the dihydrocarbyl phosphorodithioic acids, one of the hydrocarbyl groups (E-1) is an isopropyl or secondary butyl group, the other hydrocarbyl group (E-2) is a secondary hydrocarbyl group containing at least 5 carbon atoms, and at least about 20 mole percent of all of the hydrocarbyl groups present in (E) are isopropyl groups, secondary butyl groups or mixtures thereof. These lubricating oil compositions which are particularly useful in lubricating alcohol-fueled, spark-ignited engines generally will contain less than 1.3% by weight of total sulfated ash and less than 0.4% by weight of sulfated ash as calcium.

The following examples illustrate the lubricating oil compositions of the present invention.

| | Parts/Wt. |
|---|---|
| Oil Example 1 | |
| Product of Example B-1 | 2.0 |
| Product of Example C-1 | 6.0 |
| Mineral Oil (10W30) | 92 |
| Oil Example 2 | |
| Magnesium overbased alkyl (number average molecular weight about 500) benzene sulfonate having a metal ratio of 13.0 and a total base number of 400 comprising 45% oil. Available commercially as Hybase M-400 from Witco Corp. | 1.7% |
| Product of Example C-1 | 5.5% |
| Mineral Oil (10W30) | 92.8 |
| Oil Example 3 | |
| Basic magnesium alkylated benzene sulfonate (34% oil, metal ratio of 3) | 2 |
| Product of Example C-2 | 7 |
| Mineral Oil (5W30) | 91 |
| Oil Example 4 | |
| Hybase M-400 | 1.5 |
| Product of Example D-1 | 3 |
| Mineral Oil (10W30) | 95.5 |
| Oil Example 5 | |
| Hybase M-400 | 1.5 |
| Product of Example D-1 | 2 |
| Product of Example D-8 | 4.0 |
| Mineral Oil (10W30) | 92.5 |
| Oil Example 6 | |
| Hybase M-400 | 1.5 |
| Product of Example D-1 | 1.1 |
| Product of Example D-8 | 4.0 |
| Mineral Oil (10W30) | 93.4 |
| Oil Example 7 | |
| Hybase M-400 | 1.5 |
| Product of Example D-1 | 2.0 |
| Product of Example F-2 | 0.3 |
| Product of Example D-7 | 4.0 |
| Mineral Oil (10W30) | 92.2 |
| Oil Example 8 | |
| Magnesium overbased alkyl (number average molecular weight of about 500) benzene sulfonate having a metal ratio of 14.7 and a total base number of 400 (42% oil) | 1.7 |
| Product of Example C-1 | 6.0 |
| Product of Example D-1 | 2.0 |
| Product of Example D-8 | 4.0 |
| Product of Example E-1 | 1.15 |
| Product of Example F-2 | 0.4 |
| Propylene tetramer phenol reacted with sulfur dichloride (42% oil) | 2.5 |
| Viscosity Index Improver (hydrogenated copolymer of isoprene-styrene) | 6.2 |

-continued

| | Parts/Wt. |
|---|---|
| Mineral Oil (10W30) | remainder |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A lubricating oil composition for gasoline fueled or alcohol fueled spark-ignited engines or both, which comprises:

(A) an oil of lubricating viscosity;

(B) at least one detergent selected from the group consisting of a basic magnesium salt of an organic acid, and a mixture of at least one basic magnesium salt of an organic acid and another alkaline earth metal salt of an organic acid wherein more than 50% of the metal in the mixture is magnesium; and (C) at least one metal salt of (C-1) a substituted succinic acid acylated polyamine; or (C-2) a hydrocarbon-substituted aromatic carboxylic acid containing at least one hydroxyl group attached to an aromatic ring, provided that the metal of said metal salt (C) is not calcium or magnesium.

2. The composition of claim 1 wherein the detergent (B) is a basic magnesium salt of an organic acid compound, and the oil composition contains less than about 1.3% by weight sulfated ash.

3. The composition of claim 1 containing less than about 0.4% by weight sulfated ash as calcium.

4. The composition of claim 1 wherein the organic acid of detergent (B) is selected from the group consisting of sulfonic acids, carboxylic acids, phenols, and phosphorus acids.

5. The composition of claim 1 wherein the organic acid of detergent (B) is a sulfonic acid.

6. The composition of claim 1 wherein the metal salt of (C) is (C-1) and comprises the reaction product of (C-1-a) about 2 equivalents of at least one substituted succinic acylating agent consisting of hydrocarbon substituent groups and succinic groups wherein the substituent group has a number average molecular weight of at least about 700, and (C-1-b) about 1 equivalent of a basic metal reactant; and (C-1-c) from about 1 to about 5 equivalents of an amine compound containing at least one HN< group.

7. The composition of claim 6 wherein the metal of the metal salt is zinc.

8. The composition of claim 6 wherein the amine (C-1-c) is a polyamine.

9. The composition of claim 1 wherein the salt (C) is (C-2) and the aromatic carboxylic acid of (C-2) comprises at least one compound represented by the formula

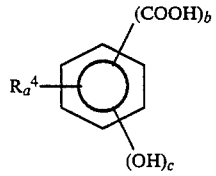

(III)

wherein $R^4$ is an aliphatic hydrocarbyl group, a is a number in the range of from 0 to about 4, b is a number in the range of from 1 to about 4, c is a number in the range of from 1 to about 4 with the proviso that the sum of a, b and c does not exceed 6.

10. The composition of claim 8 wherein the carboxylic acid of (C-2) comprises a salicylic acid.

11. The composition of claim 1 wherein the oil composition also contains (D) at least one carboxylic derivative composition produced by reacting (D-1) at least one substituted succinic acylating agent with (D-2) a reactant selected from the group consisting of at least one amine compound containing at least one HN< group; at least one alcohol; or mixtures of said amines and alcohols.

12. The composition of claim 11 wherein the carboxylic derivative composition (D) is produced by reacting (D-1) at least one substituted succinic acylating agent with (D-2) at least one amine compound containing at least one HN< group wherein said substituted succinic acylating agents consist of hydrocarbon substituent groups and succinic groups wherein the substituent groups are derived from polyalkene, said polyalkene having an Mn value of 1300 to about 5000 and an Mw/Mn value of about 1.5 to about 4.5, said acylating agents containing an average of at least 1.3 succinic groups for each equivalent weight of substituent groups.

13. The composition of claim 12 wherein the carboxylic derivative composition (D) is a carboxylic ester derivative composition produced by reacting (D-1) at least one substituted succinic acylating agent comprising substituent groups and succinic groups wherein the substituent groups are derived from polyalkene, said polyalkene having an Mn value of 1300 to about 5000 and an Mw/Mn value of about 1.5 to about 4.5, said acylating agents having an average of at least 1.3 succinic groups for each equivalent weight of substituent groups; with (D-2) at least one alcohol of the general formula $$R^3(OH)m \qquad \text{(XII)}$$

wherein $R^3$ is a monovalent or polyvalent organic group joined to the —OH groups through carbon bond, and m is an integer of from 1 to about 10.

14. The oil composition of claim 11 containing a major amount of oil (A) and at least about 1% by weight of the carboxylic derivative composition (D).

15. The oil composition of claim 12 wherein the substituent groups in (D) are derived from polybutene in which at least about 50% of the total units derived from butenes is derived from isobutene.

16. The oil composition of claim 11 wherein in (D), from about 0.5 equivalent up to about 2 moles of the amine (D-2) is reacted per equivalent of acylating agent (D-1).

17. The oil composition of claim 11 wherein in (D) from about one equivalent up to two moles of the amine (D-2) are reacted per equivalent of acylating agent (D-1).

18. The oil composition of claim 11 wherein the amine (D-2) is an aliphatic, cycloaliphatic or aromatic polyamine.

19. The oil composition of claim 11 wherein the amine (D-2) is a hydroxy substituted monoamine, polyamine, or mixtures thereof.

20. The oil composition of claim 11 wherein the alcohol (D-2) is neopentyl glycol, ethylene glycol, glycerol, pentaerythritol, sorbitol, monoalkyl or monoaryl ethers of a poly(oxyalkylene) glycol, or mixtures of any of these.

21. The composition of claim 1 wherein the oil composition also contains (E) a mixture of metal salts of dihydrocarbyl phosphorodithioic acids wherein in at least one of the dihydrocarbyl phosphorodithioic acids, one of the hydrocarbyl groups (E-1) is an isopropyl or secondary butyl group, the other hydrocarbyl group (E-2) is a secondary hydrocarbyl group containing at least 5 carbon atoms, and at least about 20 mole percent of all of the hydrocarbyl groups present in (E) are isopropyl groups, secondary butyl groups or mixtures thereof.

22. The oil composition of claim 21 wherein the other hydrocarbyl group (E-2) contains from about 6 to about 13 carbon atoms.

23. The oil composition of claim 21, wherein the metal of (E) is a Group II metal, aluminum, tin, iron, cobalt, lead, molybdenum, manganese, nickel or copper.

24. The oil composition of claim 21 wherein metal of (E) is zinc, copper, or mixture of zinc and copper.

25. The oil composition of claim 21 wherein the metal of (E) is zinc.

26. The oil composition of claim 21 wherein the metal salt in (E) is derived from a dihydrocarbyl phosphorodithioic acid prepared by reacting phophorus pentasulfide with an alcohol mixture comprising at least 20 mole percent of isopropyl alcohol and at least one secondary aliphatic alcohol containing from about 6 to about 13 carbon atoms.

27. The oil composition of claim 1 also containing (F) at least one sulfurized olefin.

28. The oil composition of claim 27 wherein the sulfurized olefin (F) is a sulfurized adduct of at least one dienophile selected from the group consisting of alpha, beta-ethylenically unsaturated aliphatic carboxylic acid esters, amides and halides with at least one aliphatic conjugated diene.

29. A lubrication oil composition for gasoline fueled or alcohol fueled spark-ignited engines, or both, having a sulfate ash content of less than about 1.3% and which comprises:

(A) a major amount of oil of lubrication viscosity;

(B) at least one detergent selected from the group consisting of a basic magnesium salt of an organic acid, and a mixture of at least one basic magnesium salt of an organic acid and another alkaline earth metal salt of an organic acid wherein more than 50% of the metal in the mixture is magnesium; and (C) at least one metal salt of a substituted succinic acid acylated polyamine obtained by reacting (C-1-a) about 2 equivalents of at least one substituted succinic acylating agent consisting of hydrocarbon substituent groups and succinic groups wherein the substituent group has a number average molecular weight of at least about 700 with (C-1-b) about 1 equivalent of a basic metal reactant; and (C-1-c) from about 1 to about 5 equivalents of an amine compound having at least one HN< group; and (D) at least one carboxylic derivative composition produced by reacting (D-1) at least one substituted succinic acylating agent with (D-2) a reactant selected from the group consisting of at least one amine compound having at least one HN< group; at least one alcohol; or mixtures of said amines and alcohols.

30. The oil composition of claim 29 having less than 0.4% by weight sulfated ash as calcium.

31. The oil composition of claim 29 wherein the organic acid of detergent (B) is an organic sulfonic acid.

32. The oil composition of claim 29 wherein the metal of metal salt (C) is lead, cadmium, zinc, nickel, cobalt, or an alkaline earth metal other than calcium.

33. The oil composition of claim 32 wherein the metal of (C) is zinc.

34. The oil composition of claim 29 wherein the amine (C-1-c) is an alkylene polyamine or a hydroxyalkyl-substituted alkylene polyamine having up to about carbon atoms in the alkylene group and up to about 6 carbon atoms in the hydroxyalkyl substituent.

35. The oil composition of claim 29 wherein the metal salt (C) is obtained by reacting about 2 equivalents of the succinic acylating agent (C-1-a) with about 1 equivalent of the basic metal reactant and about 1 equivalent of the amine (C-1-c).

36. The oil composition of claim 29 wherein the substituted succinic acylating agent (D-1) consists of substituent groups and succinic groups wherein the substituent groups are derived from a polyalkene, said polyalkene being characterized by an $\overline{M}n$ value of 1300 to about 5000 and an $\overline{M}w/\overline{M}n$ value of about 1.5 to about 4.5, said acylating agents having an average of at least 1.3 succinic groups for each equivalent weight of substituent groups.

37. The oil composition of claim 36 wherein the carboxylic derivative comprises a reaction product of at least one substituted acylating agent (D-1) and at least one amine compound having at least one HN< group.

38. The oil composition of claim 37, also containing at least one carboxylic derivative composition (D) produced by reacting (D-1) with at least one substituted succinic acylating agent with (D-2) at least one alcohol of the formula $$R^3(OH)_m$$

wherein $R^3$ is a monovalent or polyvalent organic group joined to the —OH groups through carbon bonds, and m is an integer of from 1 to about 10.

39. The oil composition of claim 29, also containing (E) a mixture of metal salts of dihydrocarbyl phosphorodithioic acids wherein in at least one of the dihydrocarbyl phosphorodithioic acids, one of the hydrocarbyl groups (E-1) is an isopropyl or secondary butyl group, the other hydrocarbyl group (E-2) is a secondary hydrocarbyl group containing at least five carbon atoms, and at least about 20 mole percent of all of the hydrocarbyl groups present in (E) are isopropyl groups, secondary butyl groups or mixtures thereof.

40. The oil composition of claim 39 wherein the other hydrocarbyl group (E-2) contains from about 6 to about 13 carbon atoms.

41. The oil composition of claim 39 wherein the metal of (E) is zinc, copper or a mixture of zinc and copper.

42. The oil composition of claim 40 wherein the metal is zinc.

43. The oil composition of claim 29 also containing (F) at least one sulfurized olefin which is a sulfurized adduct of at least one dienophile selected from the group consisting of alpha, beta-ethylenically unsaturated aliphatic carboxylic acid esters, amides and halides with at least one aliphatic conjugated diene.

44. The method of operating alcohol-fueled, spark-ignited engines which comprises lubricating said engines during operation with an oil composition comprising (A) an oil of lubricating viscosity;

(B) at least one detergent selected from the group consisting of a basic magnesium salt of an organic acid, and a mixture of at least one basic magnesium salt of an organic acid and another alkaline earth metal salt of an organic acid wherein more than 50% of the metal in the mixture is magnesium; and (D) at least one carboxylic derivative composition produced by reacting (D-1) at least one substituted succinic acylating agent with (D-2) a reactant selected from the group consisting of at least one amine compound having at least one HN< group; at least one alcohol; or mixtures of said amines and alcohols.

45. The method of claim 44 wherein the oil composition contains less than 1.% by weight of sulfated ash and less than 0.4% by weight of sulfated ash as calcium.

46. The method of claim 44 wherein the carboxylic derivative (D) is produced by reacting (D-1) at least one substituted succinic acylating agent comprising substituent groups and succinic groups wherein the substitutent groups are derived from polyalkene, said polyalkene having an $\overline{M}n$ value of 1300 to about 5000 and an $\overline{M}w/\overline{M}n$ value of about 1.5 to about 4.5, said acylating agents having an average of at least 1.3 succinic groups for each equivalent weight of substituent groups; with (D-2) at least one alcohol of the general formula $$R^3(OH)m \qquad \text{(XII)}$$

wherein $R^3$ is a monovalent or polyvalent organic group joined to the —OH groups through carbon bonds, and m is an integer of from 1 to about 10.

47. The method of claim 44 wherein the alcohol (D-2) is neopentyl glycol, ethylene glycol, glycerol, pentaerythritol, sorbitol, monoalkyl or monoaryl ethers of a poly(oxyalkylene) glycol, or mixtures of any of these.

48. The method of claim 44 wherein the oil composition also contains (E) a mixture of metal salts of dihydrocarbyl phosphorodithioic acids wherein in at least one of the dihydrocarbyl phosphorodithioic acids, one of the hydrocarbyl groups (E-1) is an isopropyl or secondary butyl group, the other hydrocarbyl group (E-2) is a secondary hydrocarbyl group containing at least 5 carbon atoms, and at least about 20 mole percent of all of the hydrocarbyl groups present in (E) are isopropyl groups, secondary butyl groups or mixtures thereof.

49. A method of operating gasoline or alcohol-fueled, spark-ignited engines, or both, which comprises lubricating said engines during operation with an oil composition which comprises:

(A) an oil of lubricating viscosity;

(B) at least one detergent selected from the group consisting of a basic magnesium salt of an organic acid, and a mixture of at least one basic magnesium salt of an organic acid and another alkaline earth metal salt of an organic acid wherein more than 50% of the metal in the mixture is magnesium; and (C) at least one metal salt of (C-1) a substituted succinic acid acylated polyamine; or (C-2) a hydrocarbon-substituted aromatic carboxylic acid containing at least one hydroxyl group attached to an aromatic ring, provided that the metal of said metal salt (C) is not calcium or magnesium.

50. A method of operating gasoline or alcohol-fueled, spark-ignited engines, or both, which comprises lubricating said engines during operation with an oil composition having a sulfate ash content of less than about 1.3% and which comprises:

(A) a major amount of oil of lubrication viscosity;

(B) at least one detergent selected from the group consisting of a basic magnesium salt of an organic acid, and a mixture of at least one basic magnesium salt of an organic acid and another alkaline earth metal salt of an organic acid wherein more than 50% of the metal in the mixture is magnesium; and (C) at least one metal salt of a substituted succinic acid acylated polyamine obtained by reacting (C-1-a) about 2 equivalents of at least one substituted succinic acylating agent consisting of hydrocarbon substituent groups and succinic groups wherein the substituent group has a number average molecular weight of at least about 700 with (C-1-b) about 1 equivalent of a basic metal reactant; and (C-1-c) from about 1 to about 5 equivalents of an amine compound having at least one HN< group; and (D) at least one carboxylic derivative composition produced by reacting (D-1) at least one substituted succinic acylating agent with (D-2) a reactant selected from the group consisting of at least one amine compound having at least one HN< group; at least one alcohol; or mixtures of said amines and alcohols.

51. A method of preventing or reducing corrosion and pre-ignition of alcohol-fueled, spark-ignited engines comprises lubricating said engines during operation with an oil composition which comprises:

(A) an oil of lubricating viscosity;

(B) at least one detergent selected from the group consisting of a basic magnesium salt of an organic acid, and a mixture of at least one basic magnesium salt of an organic acid and another alkaline earth metal salt of an organic acid wherein more than 50% of the metal in the mixture is magnesium; and (C) at least one metal salt of (C-1) a substituted succinic acid acylated polyamine; or (C-2) a hydrocarbon-substituted aromatic carboxylic acid containing at least one hydroxyl group attached to an aromatic ring, provided that the metal of said metal salt (C) is not calcium or magnesium.

52. A method of preventing or reducing corrosion and pre-ignition of alcohol-fueled, spark-ignited engines which comprises lubricating said engines during operation with an oil composition having a sulfate ash content of less than about 1.3% and which comprises:

(A) a major amount of oil of lubrication viscosity;

(B) at least one detergent selected from the group consisting of a basic magnesium salt of an organic acid, and a mixture of at least one basic magnesium salt of an organic acid and another alkaline earth metal salt of an organic acid wherein more than 50% of the metal in the mixture is magnesium; and (C) at least one metal salt of a substituted succinic acid acylated polyamine obtained by reacting (C-1-a) about 2 equivalents of at least one substituted succinic acylating agent consisting of hydrocarbon substituent groups and succinic groups wherein the substituent group has a number average molecular weight of at least about 700 with (C-1-b) about 1 equivalent of a basic metal reactant; and (C-1-c) from about 1 to about 5 equivalents of an amine compound having at least one HN< group; and (D) at least one carboxylic derivative composition produced by reacting (D-1) at least one substituted succinic acylating agent with (D-2) a reactant selected from the group consisting of at least one amine compound having at least one HN< group; at least one alcohol; or mixtures of said amines and alcohols.

* * * * *